US008950134B2

(12) United States Patent
Vaes et al.

(10) Patent No.: US 8,950,134 B2
(45) Date of Patent: Feb. 10, 2015

(54) TRIM MOLDING SYSTEM ATTACHED TO A WALL SURFACE HAVING EXISTING MOLDINGS THEREON

(75) Inventors: Ed Vaes, Hamilton (CA); Murray Van Wart, Milton (CA)

(73) Assignee: Ed Vaes, Hamilton, Ontario (CA)

( * ) Notice: Subject to any disclaimer, the term of this patent is extended or adjusted under 35 U.S.C. 154(b) by 1321 days.

(21) Appl. No.: 11/695,122

(22) Filed: Apr. 2, 2007

(65) Prior Publication Data

US 2007/0256376 A1 Nov. 8, 2007

Related U.S. Application Data

(60) Provisional application No. 60/767,511, filed on May 2, 2006.

(51) Int. Cl.
*E04F 19/04* (2006.01)
*E04F 13/08* (2006.01)

(52) U.S. Cl.
CPC ..... *E04F 19/0495* (2013.01); *E04F 2019/0454* (2013.01)
USPC ..... 52/287.1

(58) Field of Classification Search
CPC ..... E04F 13/08; E04F 13/0871; E04F 19/04; E04F 19/0454
USPC ..... 52/290, 287.1, 288.1
See application file for complete search history.

(56) References Cited

U.S. PATENT DOCUMENTS

| | | | | |
|---|---|---|---|---|
| 871,028 | A | 11/1907 | Bryan | |
| 2,887,739 | A | 5/1959 | Bensman | |
| 3,245,124 | A | 4/1966 | Faske | |
| 3,899,859 | A | 8/1975 | Smith | |
| 4,281,481 | A | 8/1981 | Wendt | |
| 5,199,237 | A | 4/1993 | Juntunen | |
| 5,625,992 | A * | 5/1997 | Strick et al. | 52/656.9 |
| 5,809,718 | A | 9/1998 | Wicks | |
| 6,021,619 | A | 2/2000 | Mansson | |
| 6,189,276 | B1 | 2/2001 | Pinto et al. | |
| 6,381,915 | B1 | 5/2002 | Wood | |
| 6,504,098 | B2 | 1/2003 | Seamans | |
| 6,516,576 | B1 | 2/2003 | Balmer | |
| 6,584,743 | B2 | 7/2003 | Paxton et al. | |
| 7,036,283 | B2 | 5/2006 | Halas | |
| 2004/0040235 | A1 * | 3/2004 | Kurtz | 52/288.1 |
| 2006/0032162 | A1 | 2/2006 | Cooper | |
| 2006/0260248 | A1 * | 11/2006 | Questel | 52/578 |

* cited by examiner

*Primary Examiner* — Michael Safavi
(74) *Attorney, Agent, or Firm* — Scott D. Smiley; Mark C. Johnson; The Concept Law Group, P.A.

(57) ABSTRACT

A trim molding system for a wall surface having an existing baseboard disposed adjacent a floor and abutting a doorway. The trim molding system comprises a capping baseboard that is attachable to the wall surface in covering relationship with the existing baseboard. The system further includes baseboard return that is attachable to the wall surface. The baseboard return is disposed between the existing vertical doorway molding and the capping baseboard by removing a portion of the existing baseboard adjacent the doorway to accommodate the baseboard return.

10 Claims, 38 Drawing Sheets

104

160
164
166

104
160
164
162

302
330
318
306

302

330
302
304

310
330
332
306
206

400

400

400
412

414
402
411
410
406
408

410
404

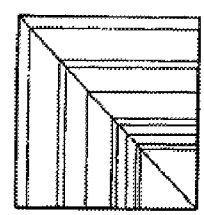
FIG. 45
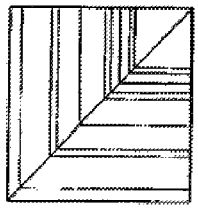
FIG. 44
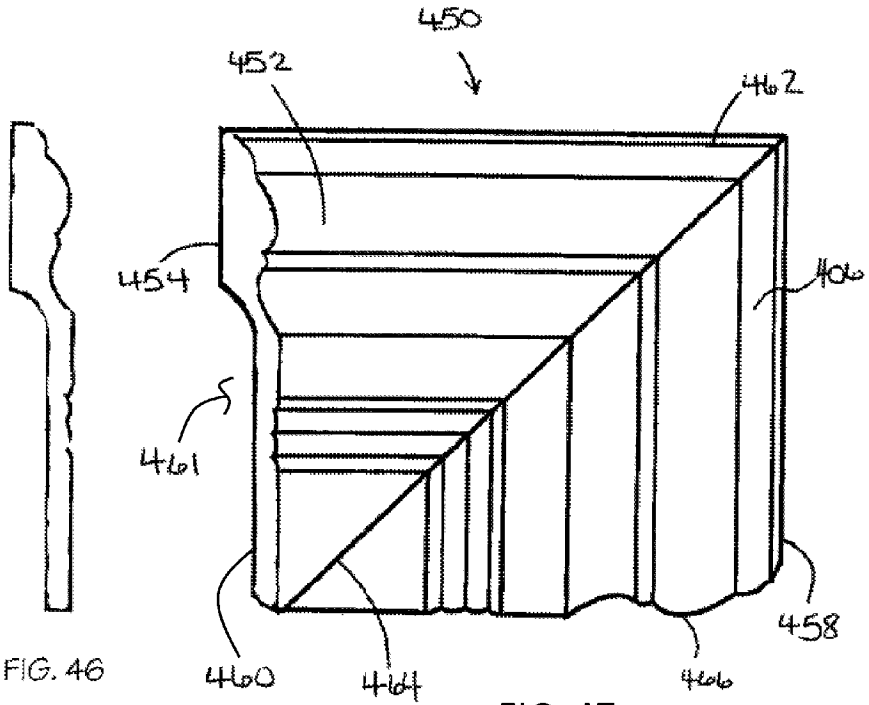
FIG. 47
FIG. 46

562
554
550
556
558
552
540
568
564
546
554

670
680
674
672
676
678
102
128
401

TRIM MOLDING SYSTEM ATTACHED TO A WALL SURFACE HAVING EXISTING MOLDINGS THEREON

The present application claims priority from previously filed U.S. provisional application 60/767,511 by Ed Vaes and Murray Van Wart on May 2, 2006.

FIELD OF THE INVENTION

The present invention relates to a trim molding system.

BRIEF DESCRIPTION OF THE DRAWINGS

The embodiments will now be described by way of example only with reference to the following drawings in which:

FIG. 44 is a front elevational view of a left hand mitered baseboard return.

FIG. 45 is a front elevational view of a right hand mitered baseboard return.

FIG. 46 is a end elevational view of a mitered baseboard return.

FIG. 47 is a schematic perspective view of a left hand mitered baseboard return.

FIG. 54 is a top elevational assembly view of a back band mitered corner together with an existing back band.

FIG. 55 is a side elevational assembly view of a back band mitered corner together with an existing back band.

FIG. 60 is a top elevational view of a transition back band.

FIG. 61 is an end elevational view of a transition back band.

FIG. 62 is an end elevational view of a transition back band.

FIG. 63 is a side elevational view of a transition back band.

FIG. 64 is an end elevational view of a transition back band.

FIG. 65 is an end elevational view of a transition back band.

DETAILED DESCRIPTION OF THE PREFERRED EMBODIMENTS

Figure 1:
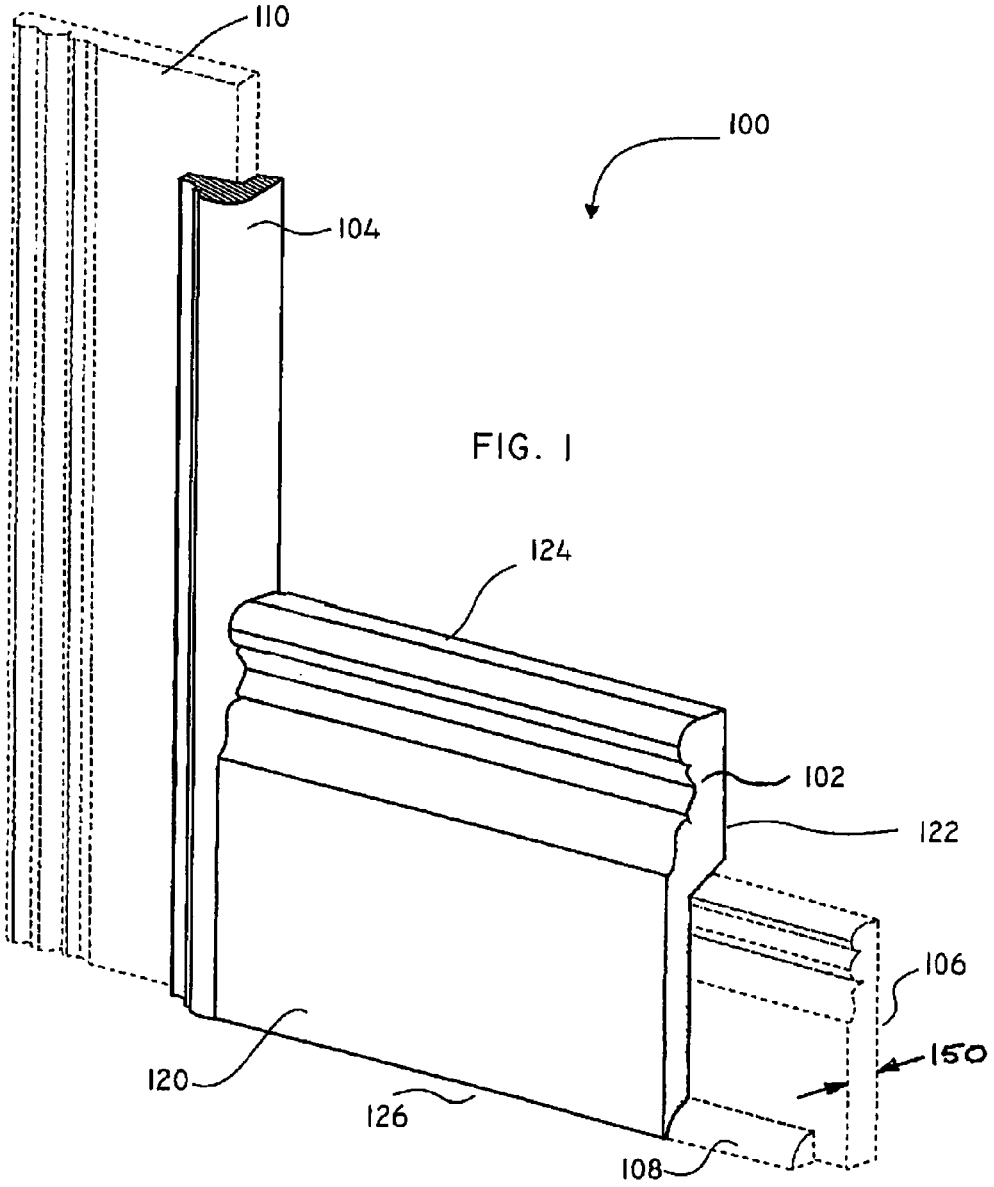
FIG. 1 is a front upright perspective view of the trim molding system showing existing components in dashed lines and added components in solid lines.
Figure 2:
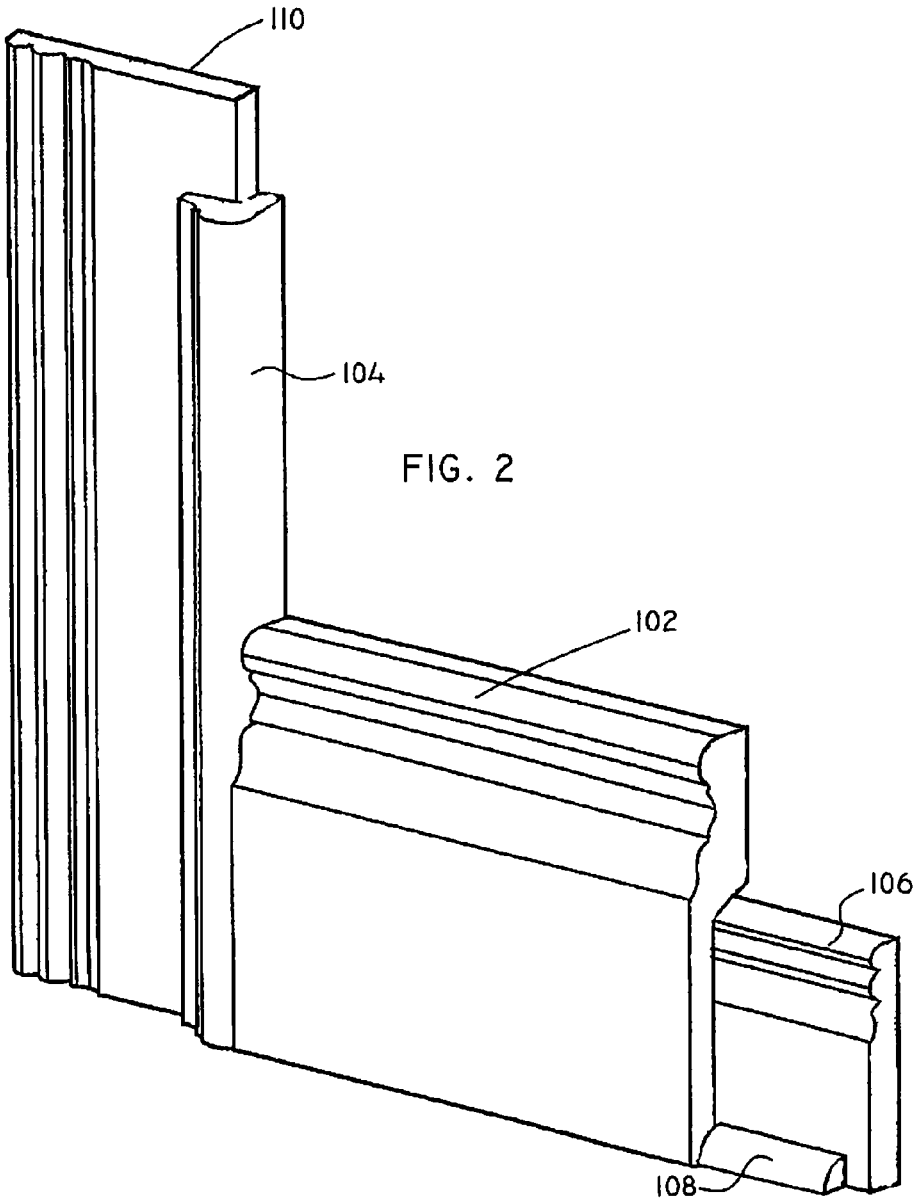
FIG. 2 is a front upright perspective view of the trim molding system showing all components in solid lines.

One embodiment of trim molding system shown generally as 100 is shown in FIGS. 1, 2, 3 and 4. Trim molding system 100 includes capping baseboard 102 and back band 104 which are components added to existing components namely existing baseboard 106, existing quarter round 108 and existing casing 110.

A person skilled in the art will note that a typical application would be for example, where baseboards are applied along the bottom of a residential home wall construction and casings are typically applied around the exterior periphery of a door opening.

Trim moldings system 100 would be used for example, for upgrading the trim moldings throughout a residential and/or commercial property.

In the example shown in FIG. 1, an existing baseboard 106 and an existing quarter round 108 are firmly attached to the walls, where the wall meets the floor. Existing casing 110 is firmly attached around the outer periphery of the door in order to complete the trim detail around the periphery of a door.

Capping baseboard 102 and back band 104 would be installed over top of existing baseboard 106, existing quarter round 108 and existing casing 110 as shown in FIG. 1.

Figure 3:
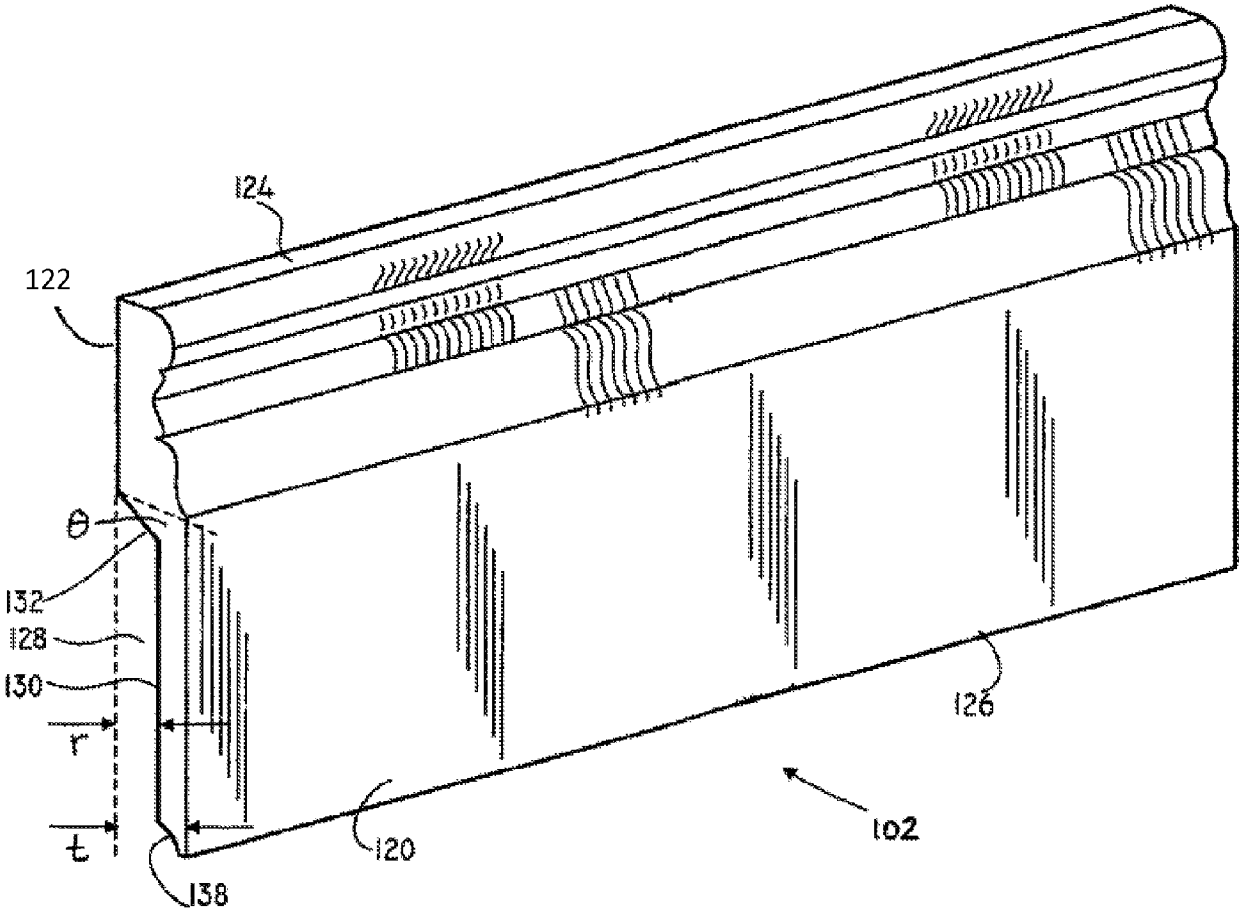
FIG. 3 is a front upright perspective view of the capping baseboard.
Figure 4:
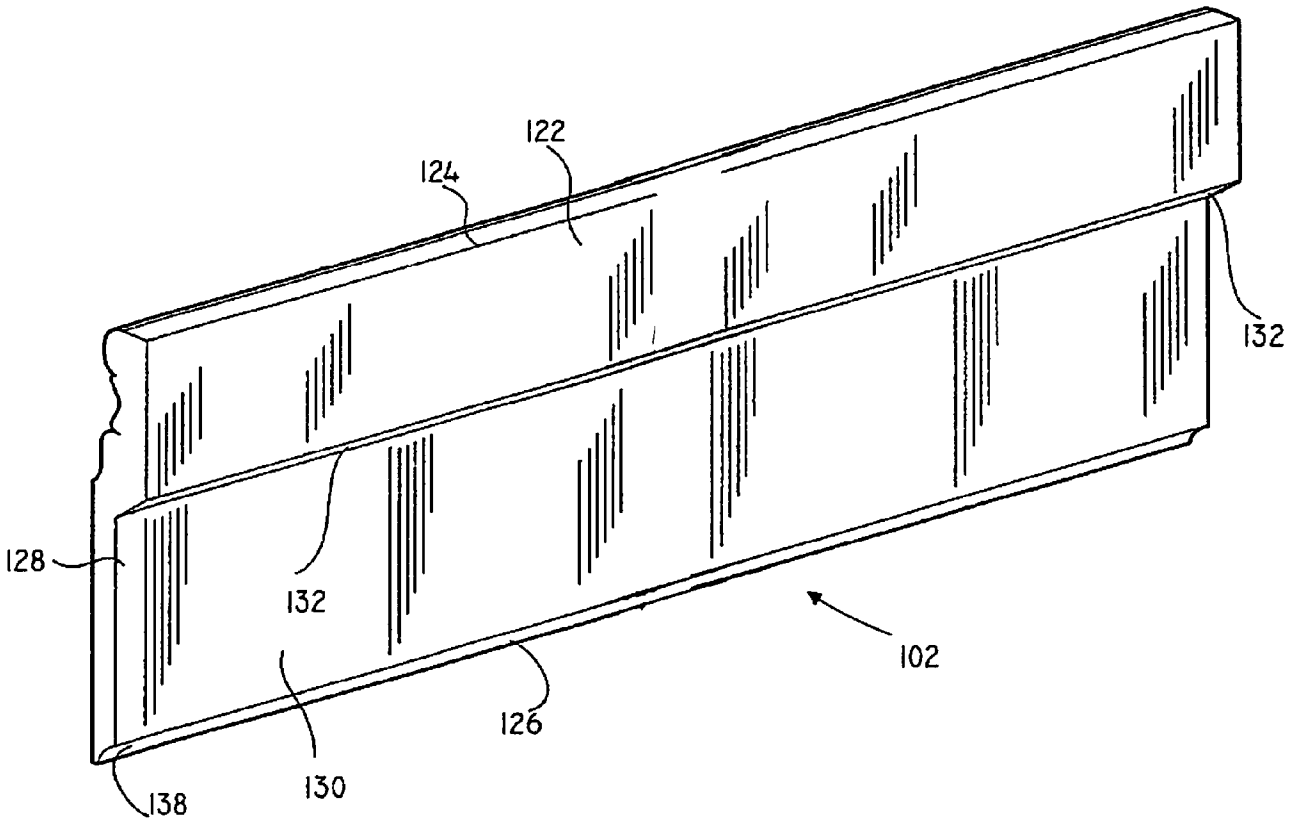
FIG. 4 is a rear upright perspective view of the capping baseboard.
Figure 5:
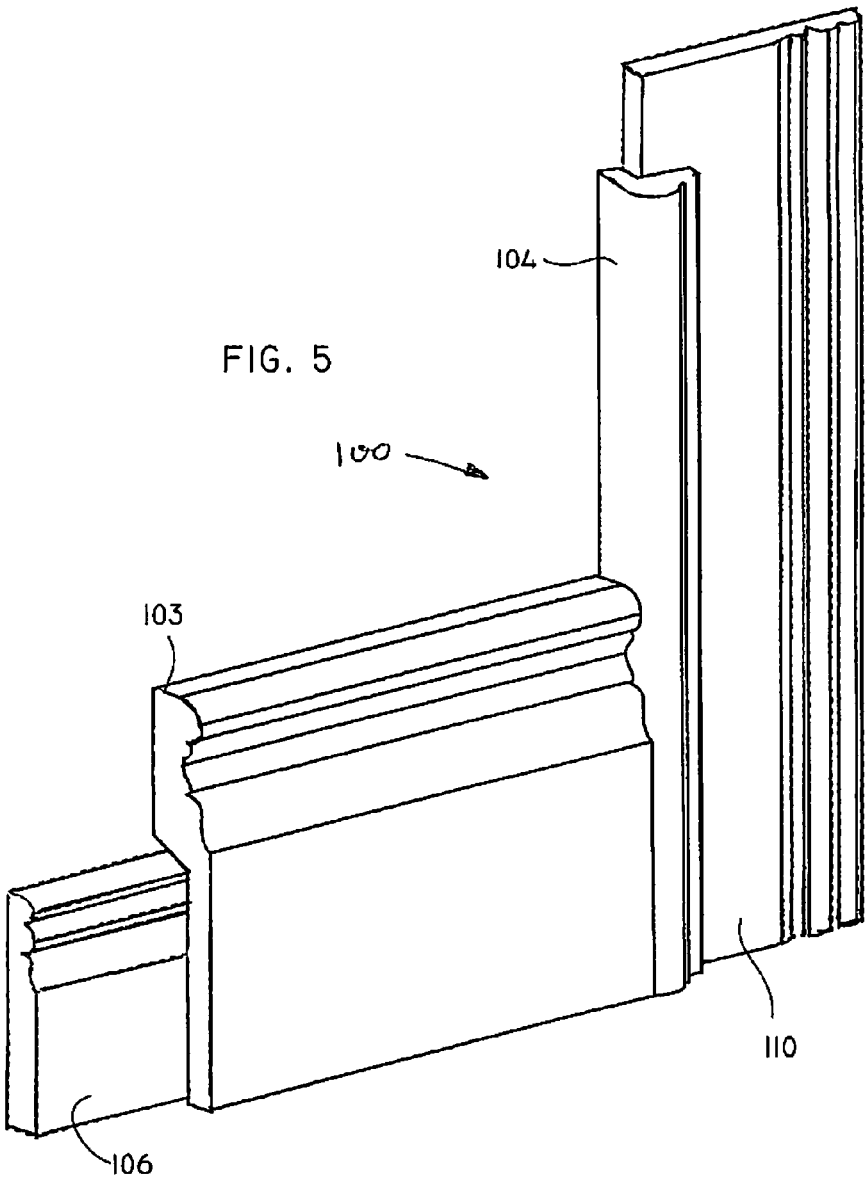
FIG. 5 is a top upright perspective view of an alternative embodiment of the present invention a trim molding system showing existing components in dashed lines and added components in solid lines.
Figure 6:
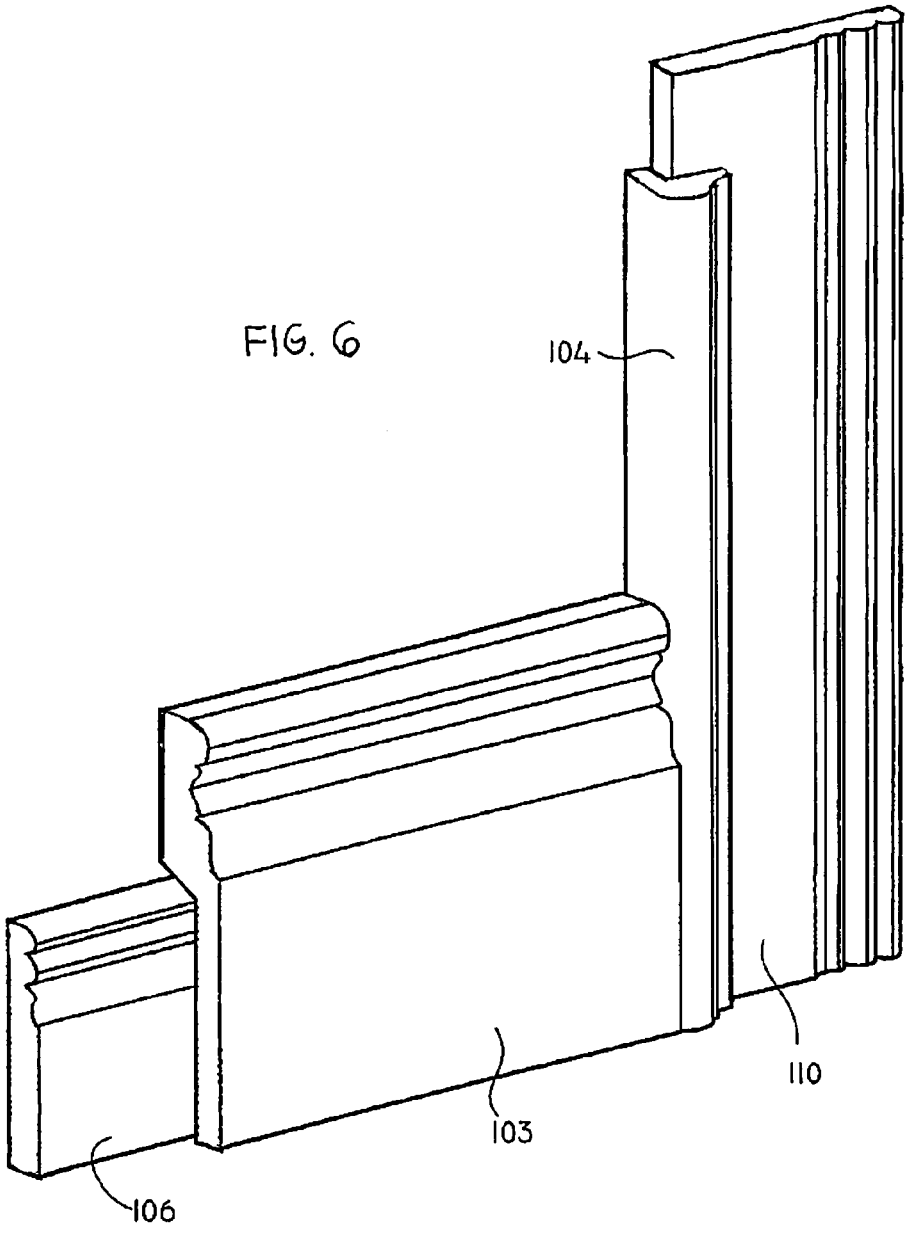
FIG. 6 is an upright front perspective view of an alternative embodiment of the trim molding system showing all components in solid lines.
Figure 7:
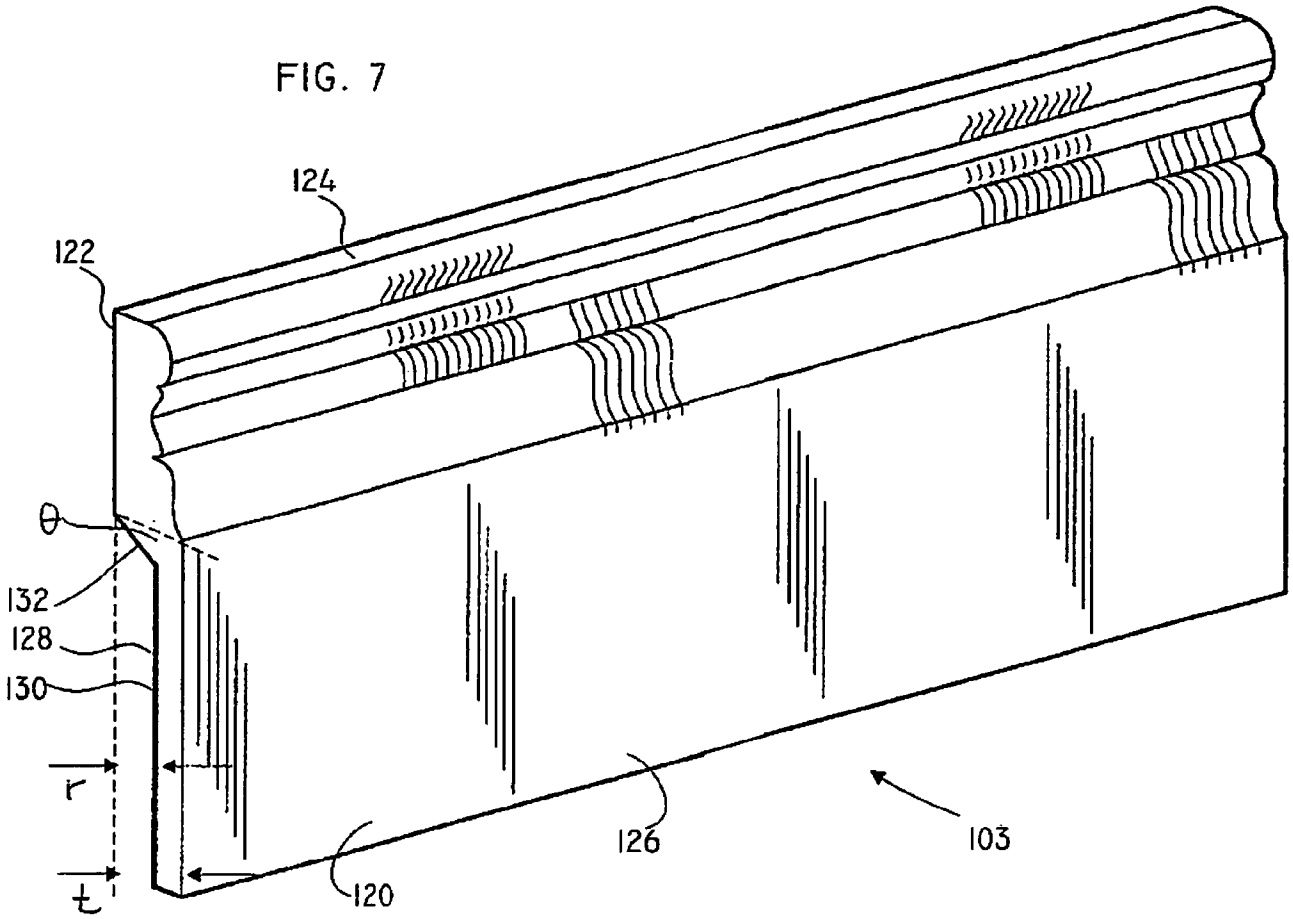
FIG. 7 is a front perspective view of an alternate embodiment of the capping baseboard.
Figure 8:
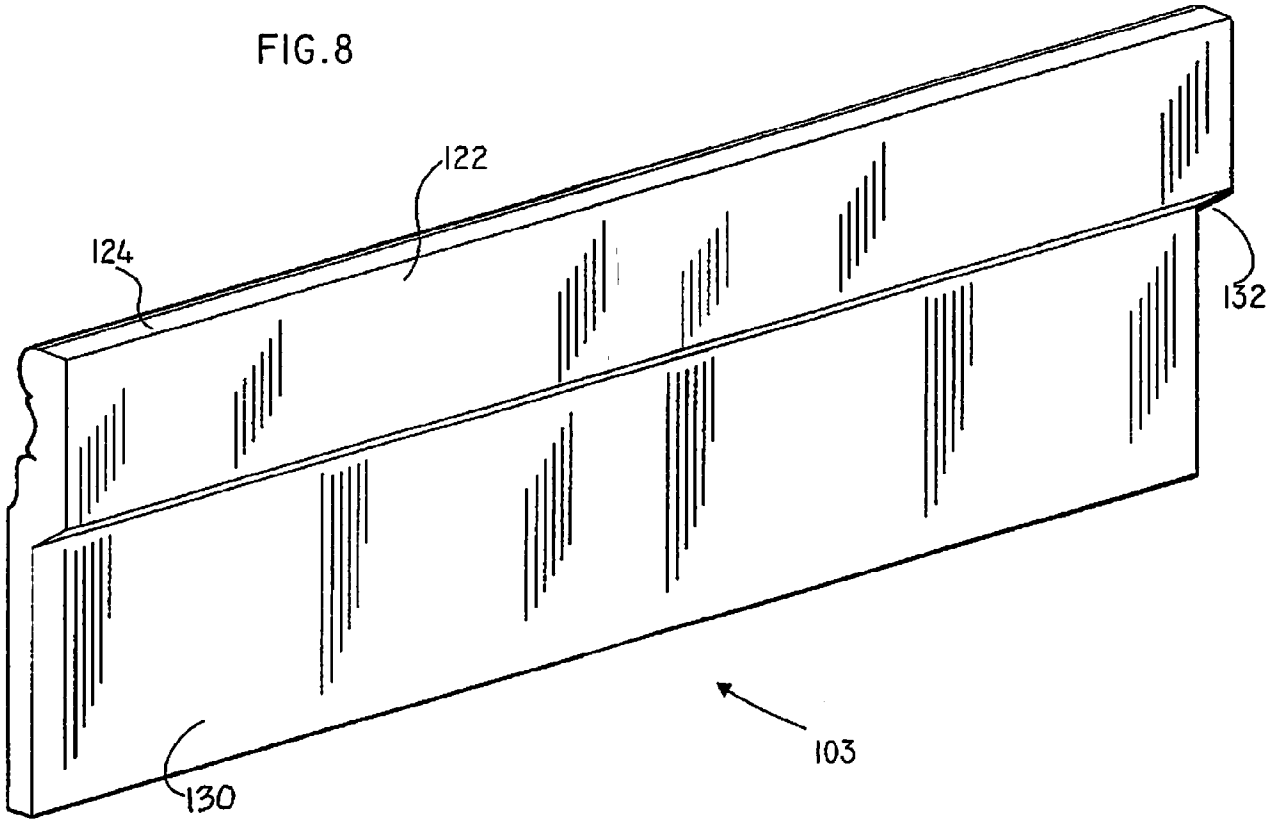
FIG. 8 is a rear perspective view of an alternate embodiment of the capping baseboard.

Referring now to FIG. 3 which is a front schematic perspective view of capping base board 102, capping baseboard 102 includes a front surface 120, back surface 122, a top side 124 and a bottom side 126. Capping baseboard 102 further includes a relief portion 128 which is a cutout of the normal cross sectional area of capping baseboard 102. Normally back surface 122 would be flat and planar along its entire length from top side 124 to bottom side 126. In this embodiment, capping baseboard 102 would include a relief 128 which has a relief back surface 130 including a transition portion 132, wherein the transition portion is disposed at a relief angle theta. Relief 128 further has a relief depth "r" of the total thickness "t" of capping baseboard 102. In addition, a bottom notch 138 is included, proximate bottom side 126 of capping baseboard 102.

Figures 9, 10, 11:
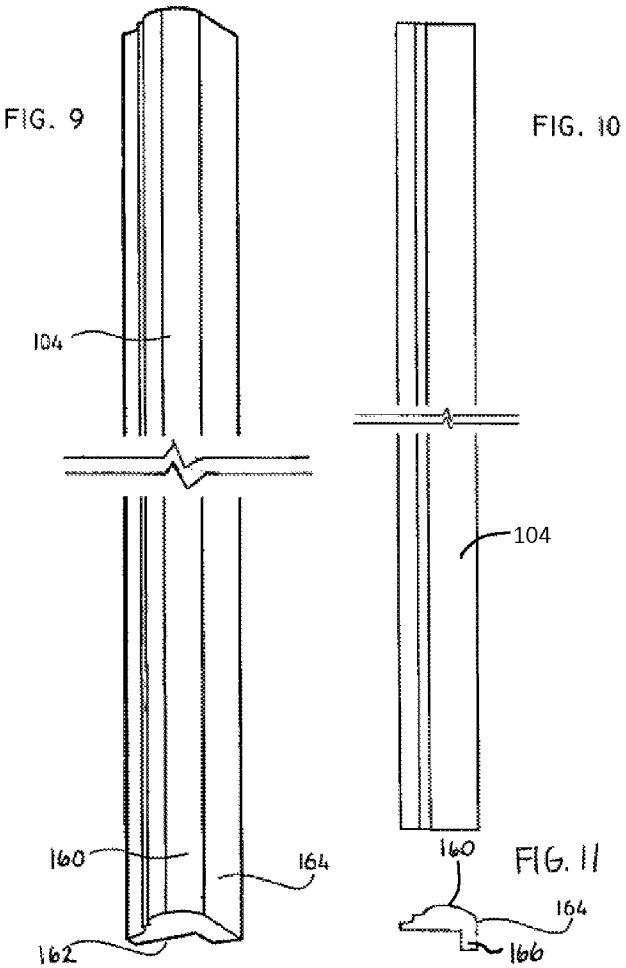
FIG. 9 is a top perspective view of the back band.
FIG. 10 is a top plan view of the back band.
FIG. 11 is a cross section view of the back band shown in FIGS. 9 and 10.
Figure 12:
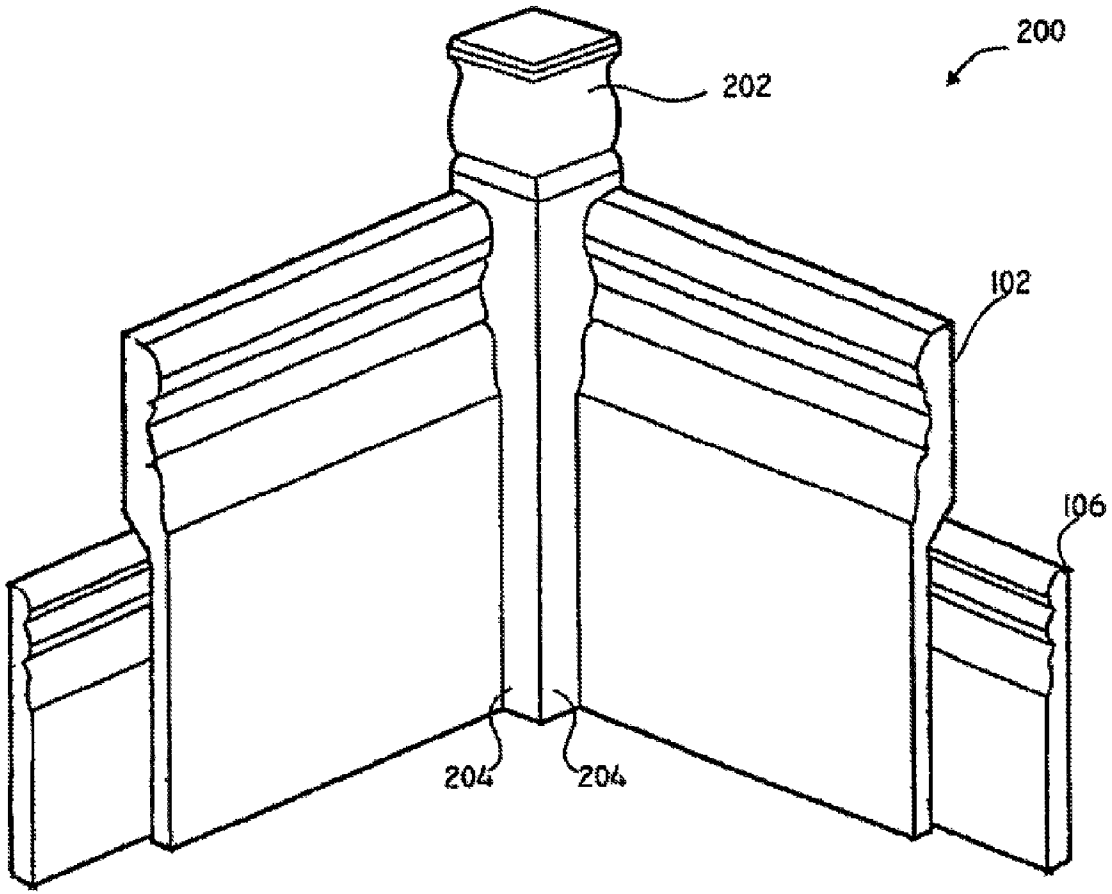
FIG. 12 is an upright perspective view of inside corner molding system together with an inside base pin.
Figure 13:
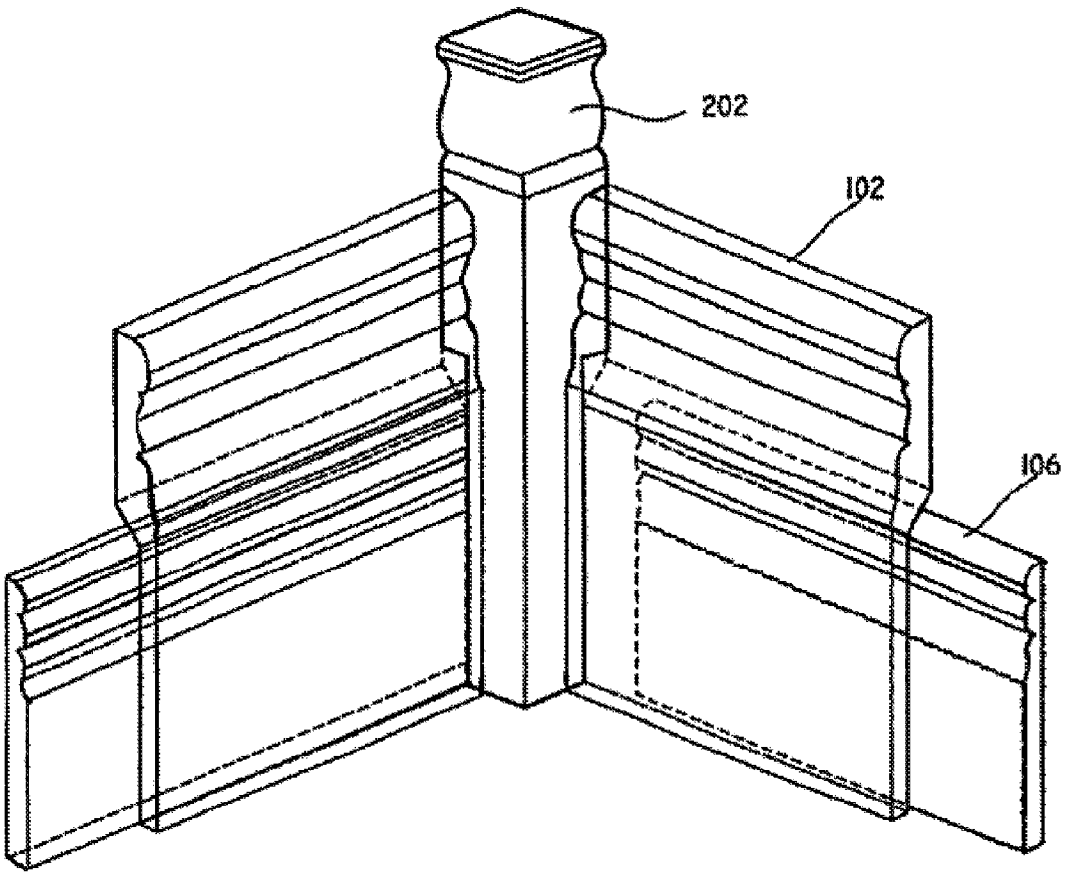
FIG. 13 is an upright perspective view of the inside corner molding system showing the baseboards in dashed lines revealing the details of the inside base pin.
Figure 14:
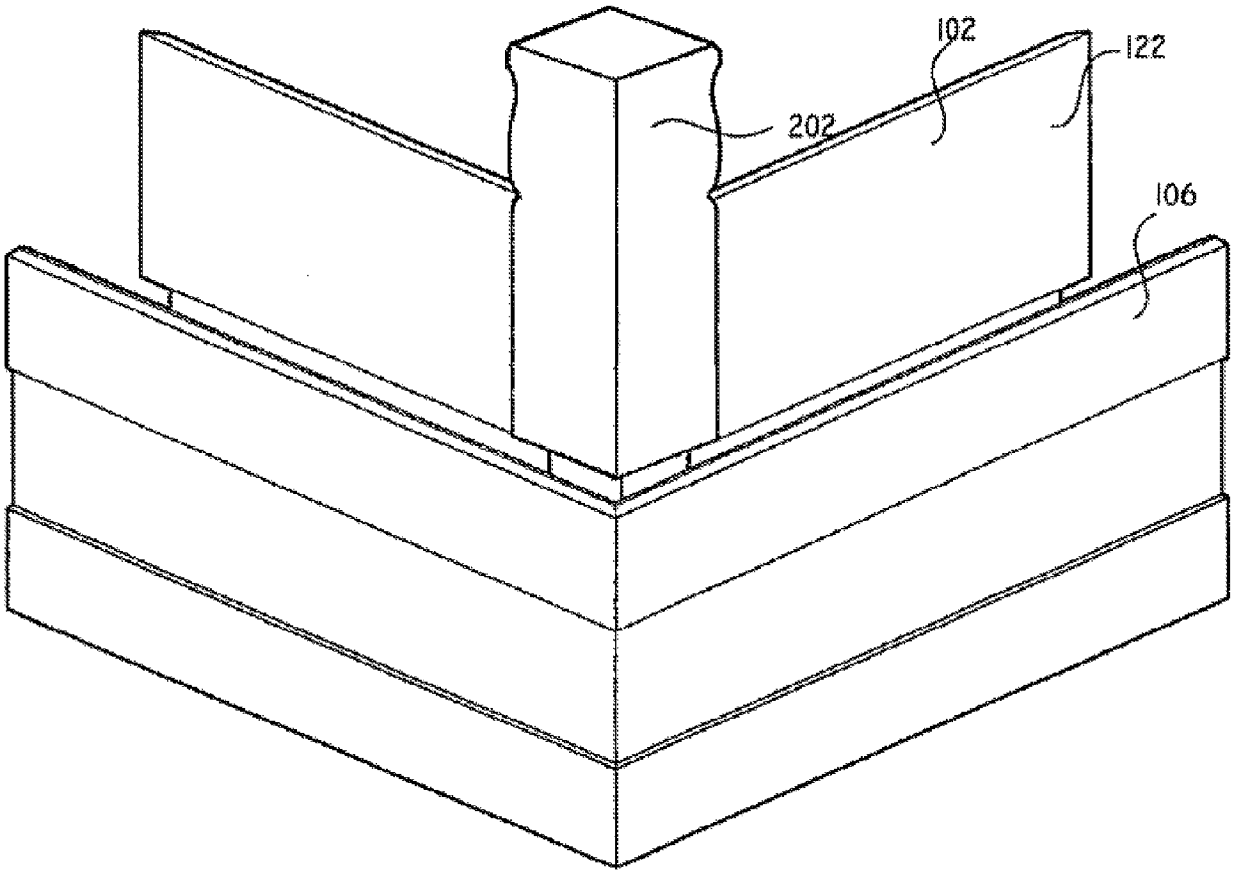
FIG. 14 is a rear upright perspective view of the inside corner molding system.
Figure 15:
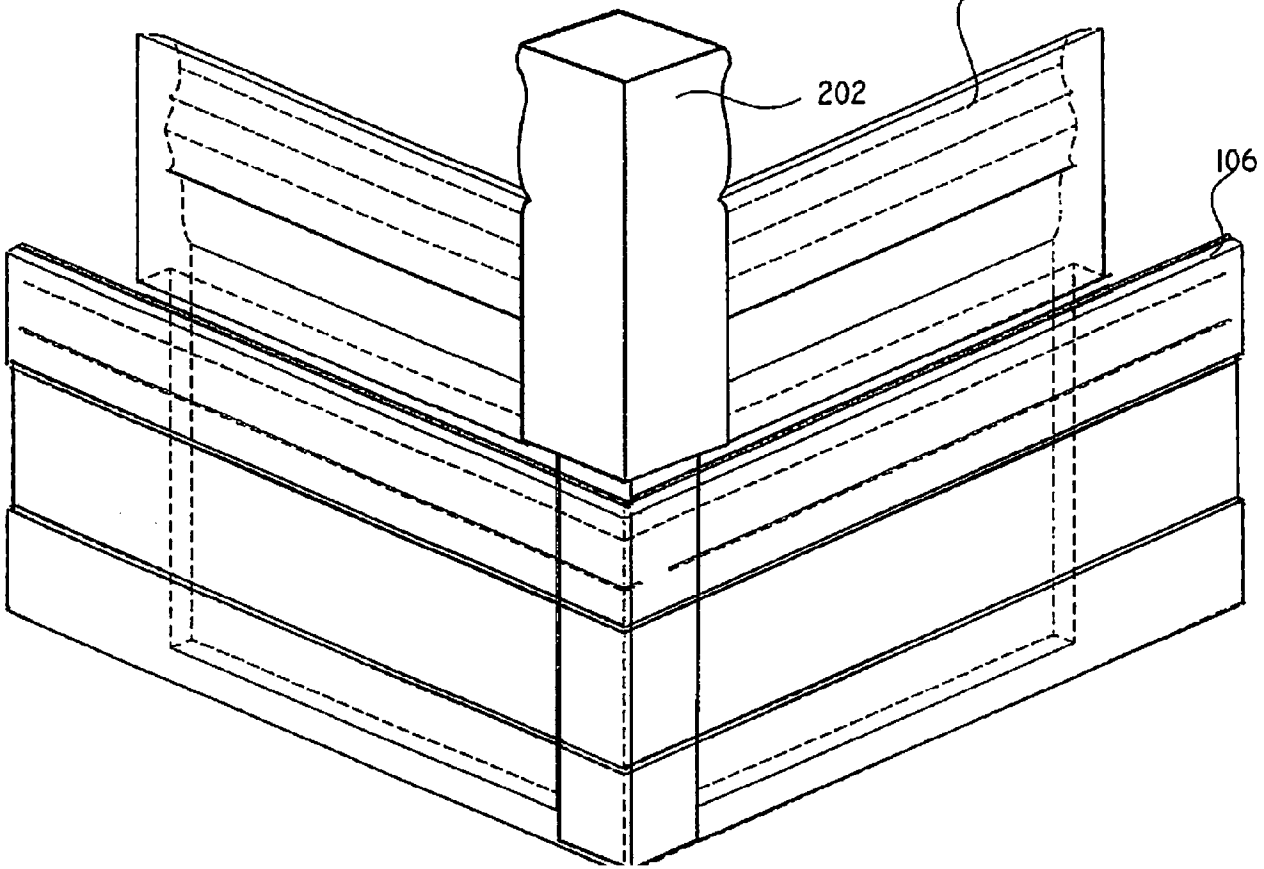
FIG. 15 is an upright perspective rear view of the inside corner molding system with the baseboards in dashed lines revealing the details of the inside base pin.
Figure 19:
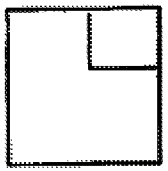
FIG. 19 is a bottom plan view of inside base pin.
Figure 18:
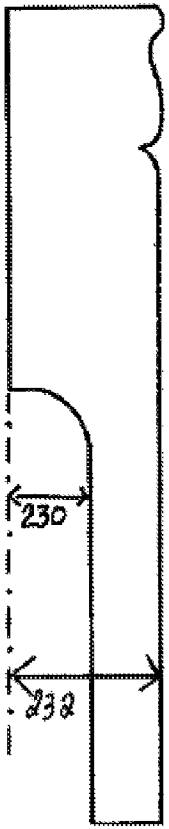
FIG. 18 is a right side elevational view of inside base pin.

Referring now to FIGS. 9, 10 and 11A, showing back band 104, back band 104 includes an outer surface 160, an inner surface 162 and an abutting surface 164.

FIGS. 5, 6, 7 and 8 show an alternate embodiment of trim molding system 100. The reader will note that capping base board 103 does not includes a bottom notch 138 and in this case there is no existing quarter round 108 as shown in FIG. 1. In some homes there may or may not be an existing quarter round 108.

Figure 36:
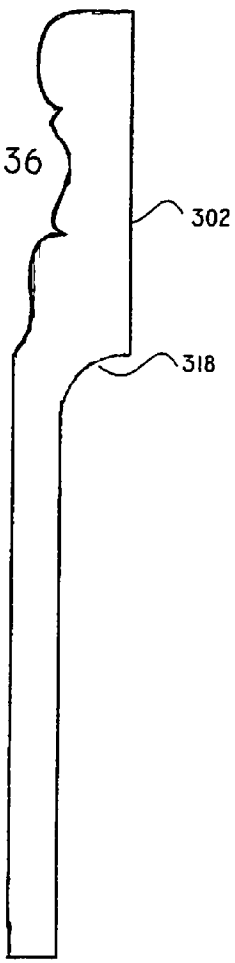
FIG. 36 is a side elevational view of outside base pin shown in FIG. 33 with a fillet transition.
Figure 35:
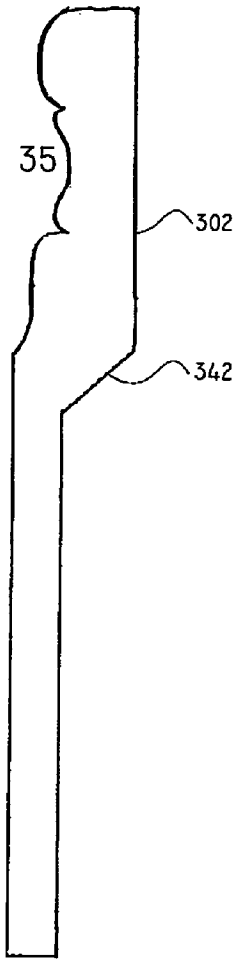
FIG. 35 is a side elevational view of outside base pin shown in FIG. 32 with a slope transition.
Figure 34:
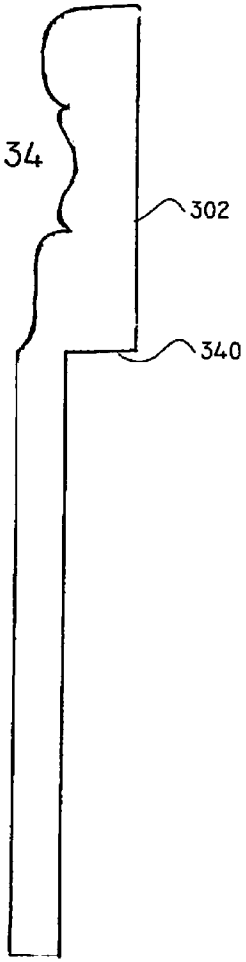
FIG. 34 is a side elevational view of base pin shown in FIG. 31 with a square transition.
Figures 37, 38, 39, 40, 41:
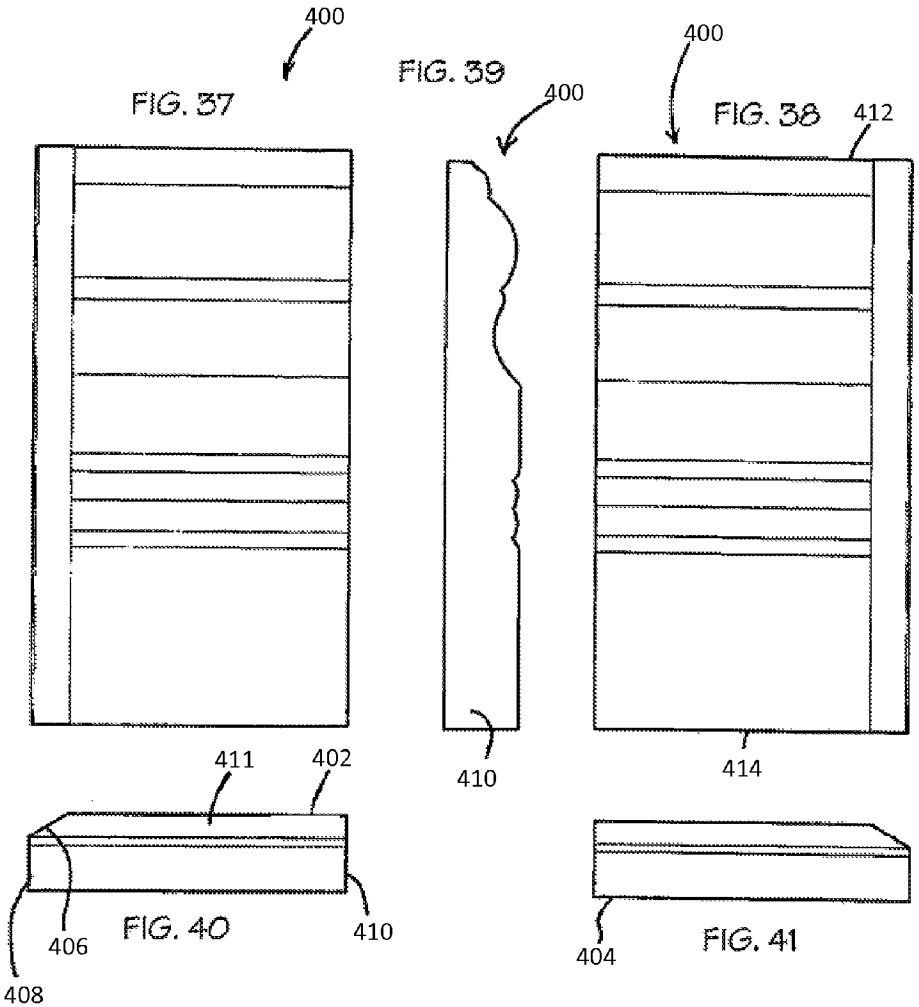
FIG. 37 is a front elevational view of a left hand baseboard return.
FIG. 38 is a front elevational view of a right hand baseboard return.
FIG. 39 is a side elevational view of a baseboard return.
FIG. 40 is an end elevational view of a left hand baseboard return.
FIG. 41 is an end elevational view of a right hand baseboard return.

Referring now to FIGS. 12 through 20, inside corner molding system 200 includes inside base pin 202 which is deployed together with an existing baseboard 10G and a capping baseboard 102. Referring more specifically to FIGS. 16 through 21, inside base pin 202 includes a front surface 204, a relief 206, a transition 208, a back surface 210, a relief back surface 212. Relief 206 has a relief depth 230 and inside base pin 202 has a total thickness 232. Transition 208 may also include transition fillet 214 which is a rounded transition rather than a square transition. Those skilled in the art will recognize that transition 208 may take on a number of different geometries, including those shown in FIGS. 34, 35 and 36.

Figure 22:
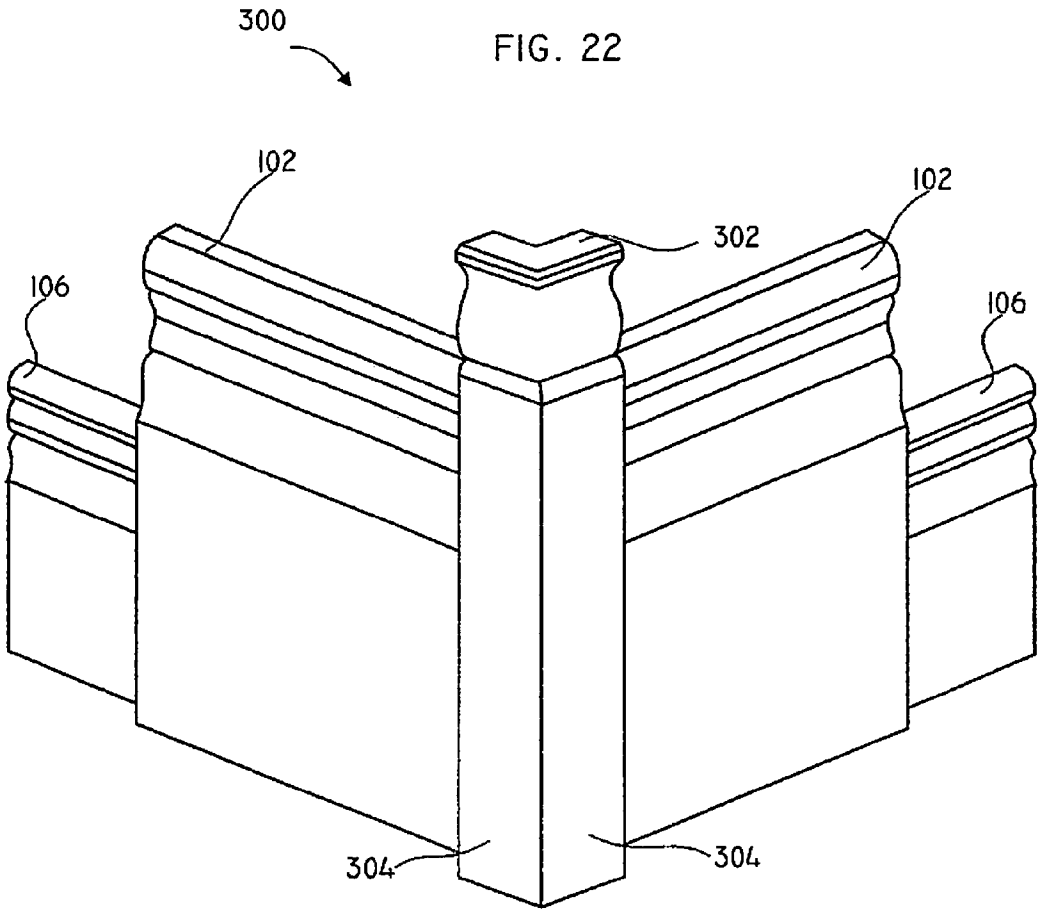
FIG. 22 is a front upright perspective view of outside corner molding system together with outside base pin.
Figure 23:
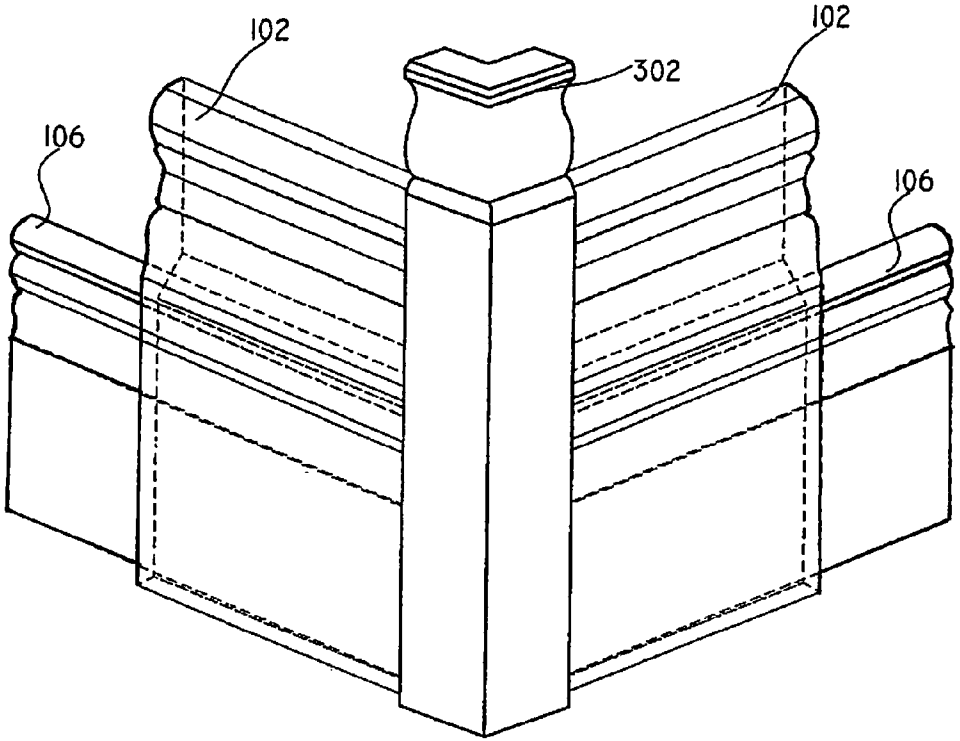
FIG. 23 is an upright perspective view of outside corner molding system with baseboard shown in dashed lines.

Referring now to FIG. 22 through to 36 inclusively, FIG. 22 particularly shows outside corner molding system 300 which shows an outside base pin 302 deployed together with existing baseboard 106 and capping baseboard 102. Referring now more specifically to FIGS. 25 through 30, outside base pin 302 includes a front surface 304 and a relief portion 306 having a transition 308. Outside base pin 302 further includes a back surface 310, side surfaces 332, a corner cut out 330 and a relief back surface 320. Transition 308 may take on a number of different geometries including transition fillet 318 or as best depicted in FIGS. 31 through 36, it may include a square transition 340, a sloped transition 342 or a fillet transition 318. A number of other geometries are possible as recognized by those skilled in the art.

In Use

Typically an existing installation will include an existing baseboard 106 which is securely fastened to the wall proximate the floor, together with existing casings 110 which are securely fastened around the outer periphery of door openings, window openings etc. In some existing installations, there may or may not be an existing quarter round 108 which abuts the walls and the floor at the junction of the existing baseboard 106 to the floor.

Presently in order to upgrade the baseboard and casing of an existing installation, one would have to remove all of the existing baseboard 106, existing quarter round 108 and existing casing 110 and then install new baseboards, casing and quarter rounds as desired.

The trim molding system 100 depicted in FIG. 1 for example, uses a capping baseboard 102 and a back band 104 in order to upgrade the trim moldings found along walls, door and window openings as an example.

Capping baseboard 102 includes a relief 128 that is dimensioned and adapted to fit over existing baseboard 106 as depicted in FIG. 1. The relief depth "r" is selected to be just slightly greater than the thickness 150 of existing baseboard 106. In this manner, existing baseboard 106 will fit into relief 128 when capping baseboard 102 is applied over top of existing baseboard 106.

In the case where there is an existing quarter round 108 an additional bottom notch 138 is included proximate bottom side 126 of capping baseboard 102 in order to cover up either partially or completely existing quarter round 108. In some installations, it may not be necessary to cover up quarter round 108, but rather to leave existing quarter round 108 in position.

In some instances the use of capping baseboard 102 to upgrade the existing trim molding in a particular building may be enough.

It is possible to not only upgrade the existing baseboard 106, but also to upgrade the existing casings 110 by installing additional back band 104 shown in FIG. 1. A person skilled in the art will note that where back band 104 meets existing baseboard 106, the installer will have to notch out back band leg 166 in order to ensure a nice flush straight fit. Inner surface 162 of back band 104 overlaps with the outer surface of existing casing 110.

The use of both capping baseboard 102 and back band 104 results in an aesthetically pleasing look, in that dimensionally the back band 104, together with the capping baseboard 102 will be proportionally correct to each other.

A person skilled in the art will realize immediately that it will not be necessary to remove existing baseboard 106 and/or existing quarter round 108 and/or existing casing 110 when using trim molding system 100.

In cases where there is no existing quarter round 108, a capping baseboard 103 which does not include a bottom notch 138 may be used for covering over existing baseboard 106.

Figure 17:
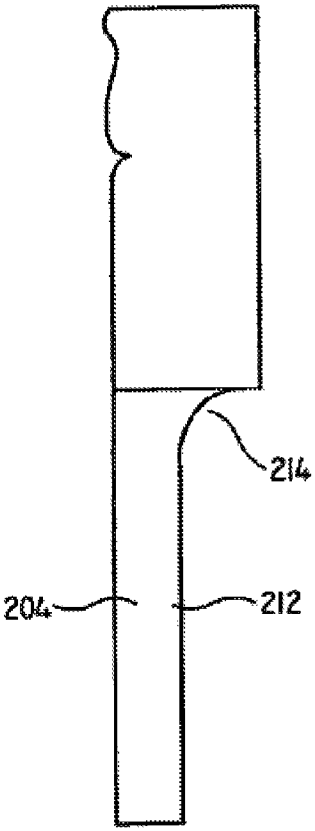
FIG. 17 is a left side elevational view of inside base pin.
Figure 16:
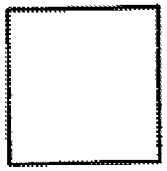
FIG. 16 is a top plan view of inside base pin.
Figure 21:
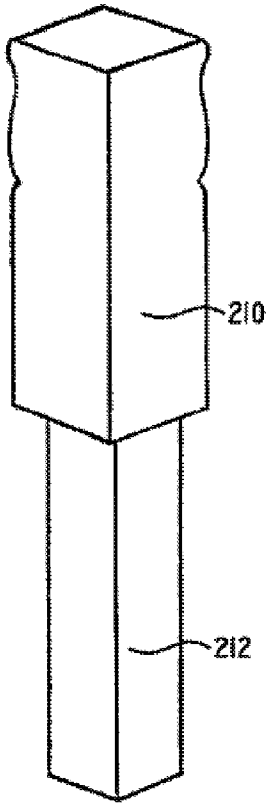
FIG. 21 is a rear upright perspective view of inside base pin.
Figure 20:
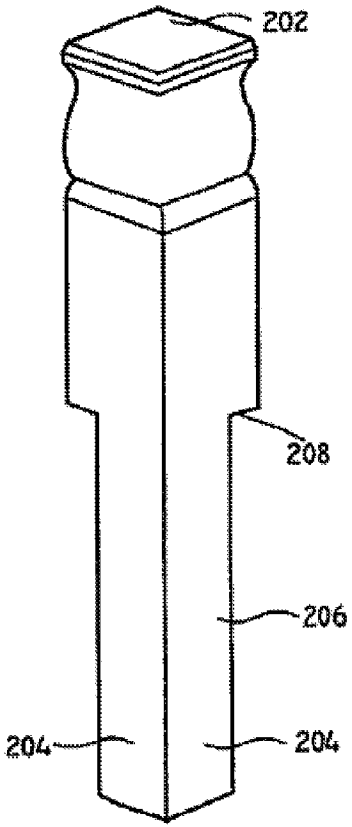
FIG. 20 is an upright perspective front view of inside base pin.
Figure 32:
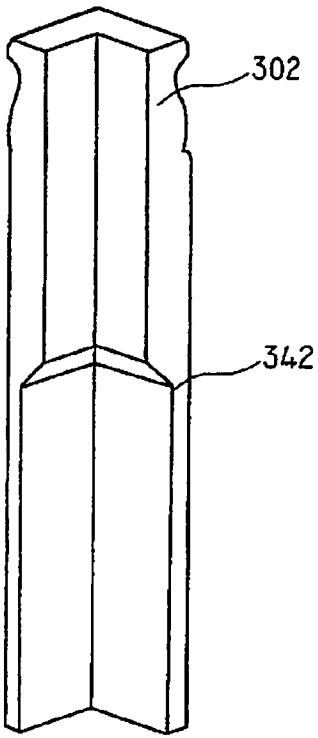
FIG. 32 is a rear upright perspective view of outside base pin showing a sloped transition.
Figure 31:
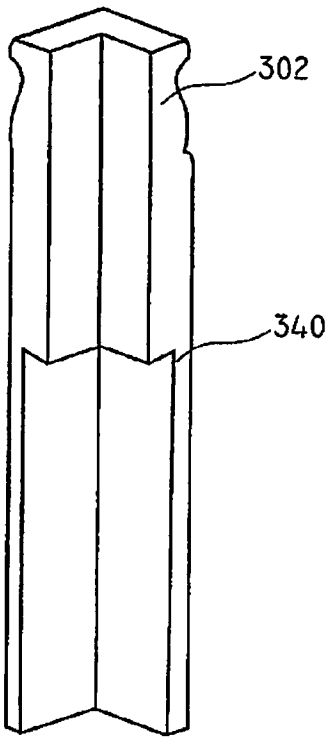
FIG. 31 is a rear upright perspective view of outside base pin showing a square transition.

The inside corner molding system 200 is used in situations where there is an inside corner. Inside base pin 202 is placed over existing based board 106. In order to accommodate the thickness of existing baseboard 106, a relief 206 is cut out of the bottom portion of inside base pin 202. Relief back surface 212 will abut against existing baseboard 106. Relief depth 230 is selected such that inside base pin 202 easily mounts over the top of existing baseboard 106 and ensuring that inside base pin 202 stands vertically true. Depending upon the contour of the top of existing baseboard 106, various different transitions 208 may be used, including a transition fillet 214 which is a rounded transition portion or a sloped transition as shown in FIG. 32 and/or a fillet transition 214 as shown in FIG. 17.

A person skilled in the art will note that inside base pin 202 can then be used with capping baseboards 102 to complete an inside corner, wherein the existing baseboards 106 are left in position. This provides for applying new capping baseboards 102 and a new inside base pin 202 without the need for removal of existing baseboards 106.

Figure 24:
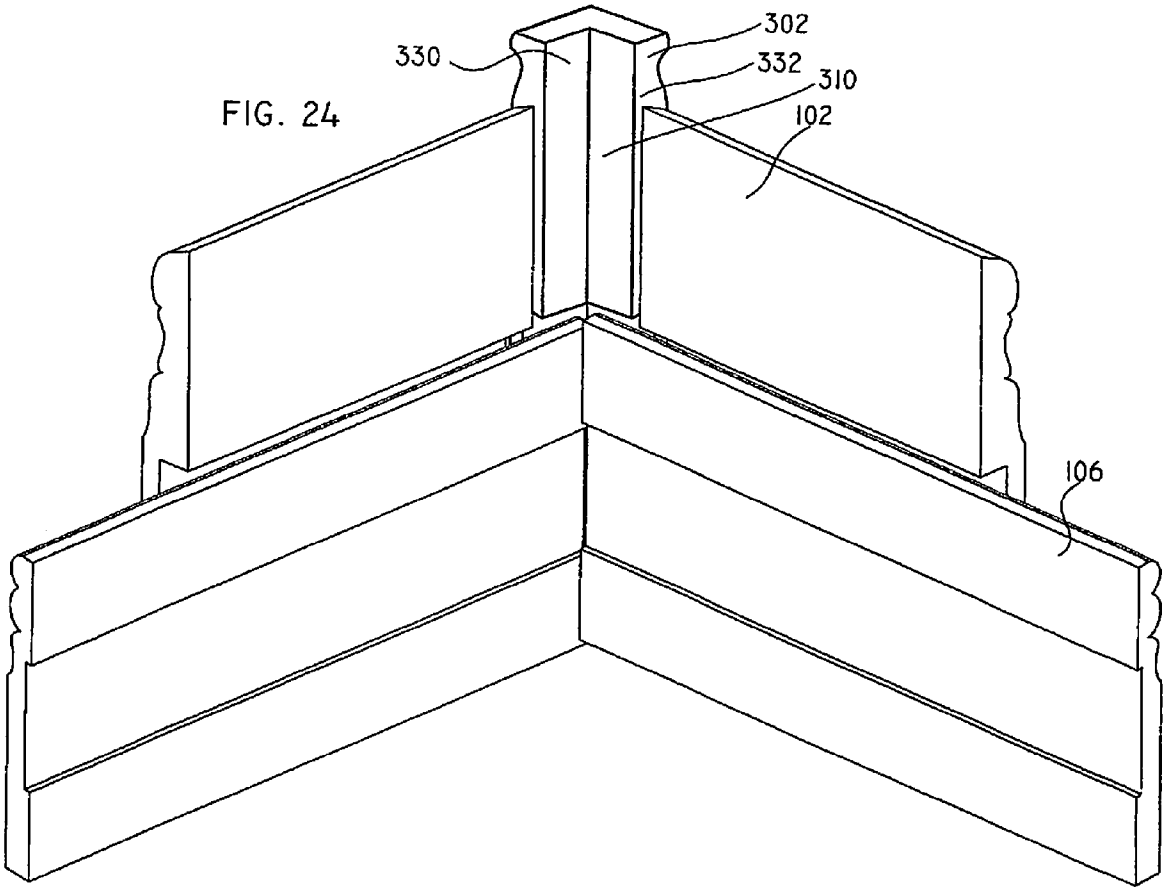
FIG. 24 is a rear upright perspective view of outside corner molding system together with outside base pin.
Figures 25, 26, 27, 28, 29, 30:
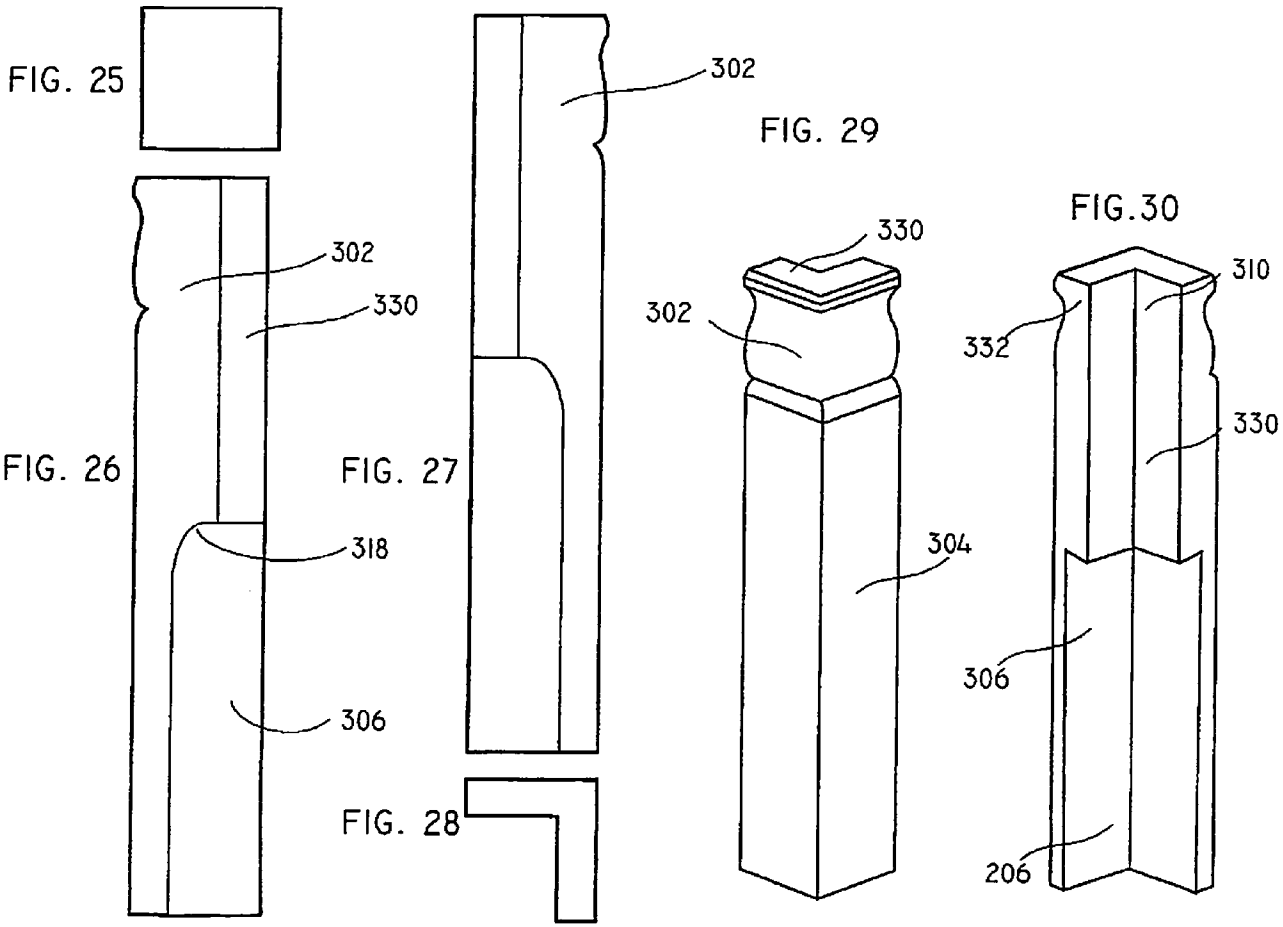
FIG. 25 is a top plan view of outside base pin.
FIG. 26 is a left side upright plan view of outside base pin.
FIG. 27 is a right side upright plan view of outside base pin.
FIG. 28 is a bottom plan view of outside base pin.
FIG. 29 is an upright perspective front view of outside base pin.
FIG. 30 is an upright perspective rear view of outside base pin.
Figure 33:
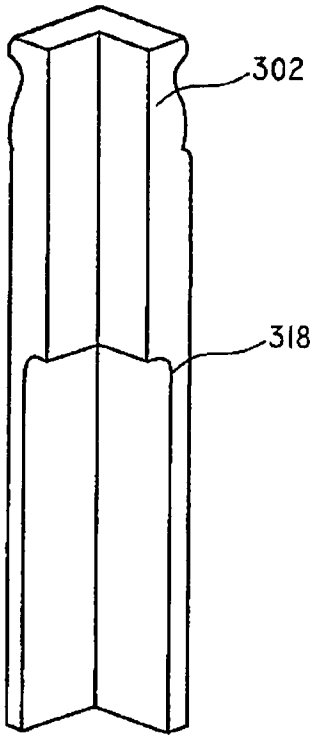
FIG. 33 is a rear upright perspective view of outside base pin showing a fillet transition.

Now referring to FIGS. 22 through 36, FIG. 22 shows outside corner molding system 300 which includes an outside base pin 302. Referring now to FIGS. 29 and 30 in particular, outside base pin 302 includes front surfaces 304, relief portion 306 having a transition 308, and a back surface 310 including a corner cutout 330. Relief 306 includes relief back surfaces 320. Outside base pin 302 has a relief depth 340 and a total thickness 342. A person skilled in the art will note that the relief depth 340 is selected to be able to mount over the top of existing base board 106, such that outside base pin 302 stands vertically true, outside base pin 302 further includes a corner cutout 330 and side surfaces 332 which are somewhat revealed as shown in FIG. 24.

Depending upon the contour of the top of existing baseboard 106, transition portion 308 may include a round transition fillet 318, a sloped transition 342 or a square transition 340 as shown in FIGS. 31 through 36.

A person skilled in the art will recognize that outside corner molding system 300 which uses an outside base pin 302, can be used to cover over an existing baseboard 106 with a capping baseboard 102 and an outside base pin 302, thereby providing for a clean finished look. A person skilled in the art will note that it is not necessary to remove existing baseboard 106 in order to install outside corner molding system 300.

Both inside corner molding system 200 and outside corner molding system 300, in addition could be used with or without the presence of a quarter round 108 as depicted in FIG. 1. In this case a capping baseboard with a notch 138 would be used, rather than with a flat surface.

A person skilled in the art will note that the use of inside base pin 202 and outside base pin 302 allows for complete renewal of baseboard casings inside and outside corners with the use of capping baseboards and back bands together with special outside and inside base pins.

Figure 42:
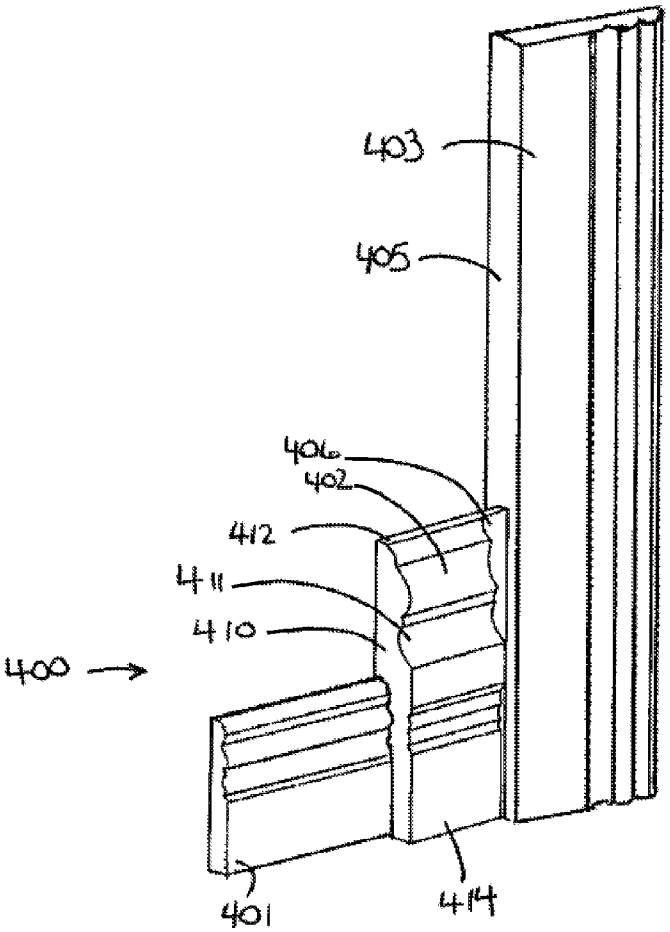
FIG. 42 is a schematic perspective assembly drawing showing the baseboard return installed with existing baseboard and door casing.
Figure 43:
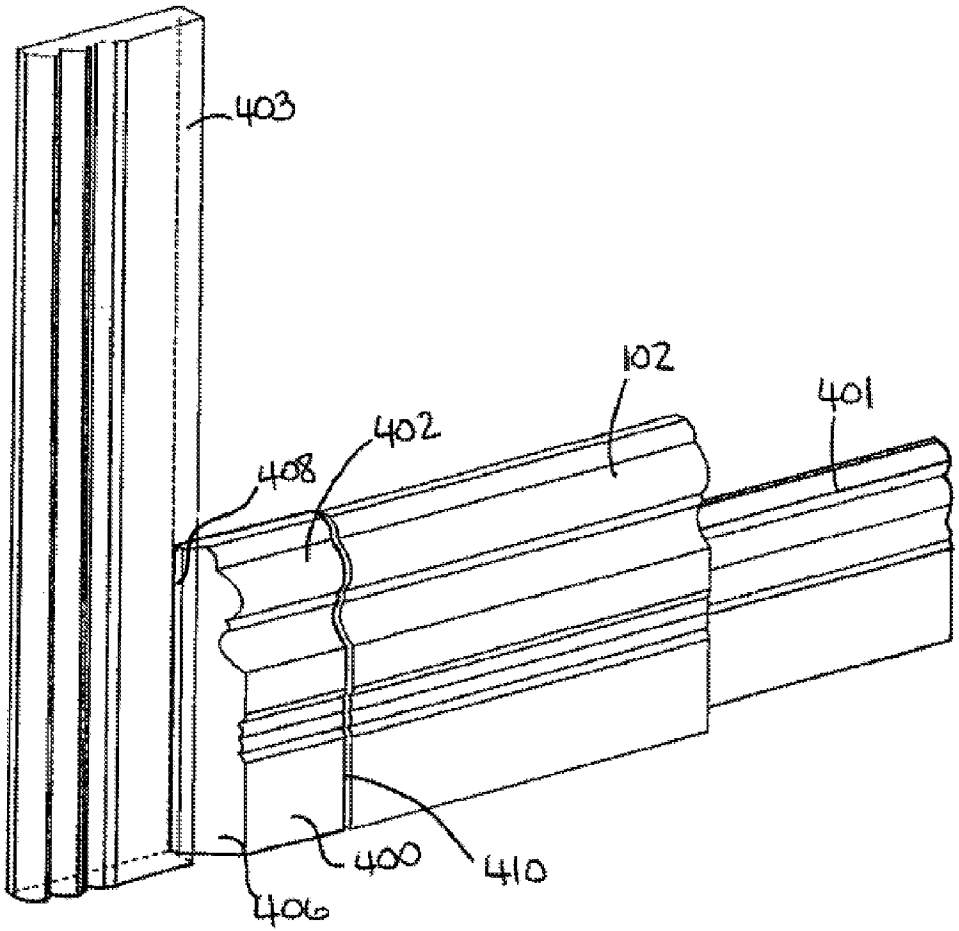
FIG. 43 is a schematic perspective assembly drawing showing the baseboard return installed with existing baseboard and door casing and capping baseboard.

FIGS. 37 through 49 show two embodiments of a baseboard return. The first embodiment is baseboard return 400 shown in FIGS. 37 through 43. Baseboard return 400 includes exposed surface 402, bottom surface 404, tapered section 406, casing abutting surface 408, baseboard abutting surface 410, top end 412 and a bottom end 414. Baseboard return 400 includes a body 411 which preferably is substantially flat or planar. Baseboard return 400 is shown together with an existing baseboard 401 and existing casing 403 having a casing abutting side 405. Baseboard return 400 can be used in situations where there is or isn't an existing baseboard 401. FIGS. 42 and 43 show baseboard return 400 being deployed together wherein existing baseboard 401 has already been installed. Baseboard return 400 could just as easily be installed in a green application, namely where there is no existing baseboard 401, but simply a new application of baseboard casing and a baseboard return 400.

Casing abutting surface 408 of baseboard return 400 abuts against casing abutting side 405 of existing casing 403. Baseboard return 400 is tapered at tapered sections 406, such that casing abutting surface 408 is slightly thinner than the thickness of casing abutting side 405. This is done so that the finished look is esthetically pleasing. It is desirable to have the casing abutting side 405 thicker than the baseboard that is being used in that it abuts up against the casing abutting side 405. Baseboard return 400 can be used in those situations where the baseboard being used is in fact thicker than the casing abutting side 405 and by utilizing tapered section 406 on baseboard return 400, one is able to produce a casing abutting surface 408 which is thinner than casing abutting side 405.

Similarly FIGS. 44 through 49 depict mitered baseboard return 450 which includes the following major components, namely an exposed surface 452, a bottom surface 454, casing abutting edge 458, baseboard abutting surface 460, and a relief portion 461 which is more or less analogous to the relief portion 128 depicted in FIG. 3.

Mitered baseboard return 450 also includes a top end 462, a bottom end 466 and a mitered line 464.

Figure 48:
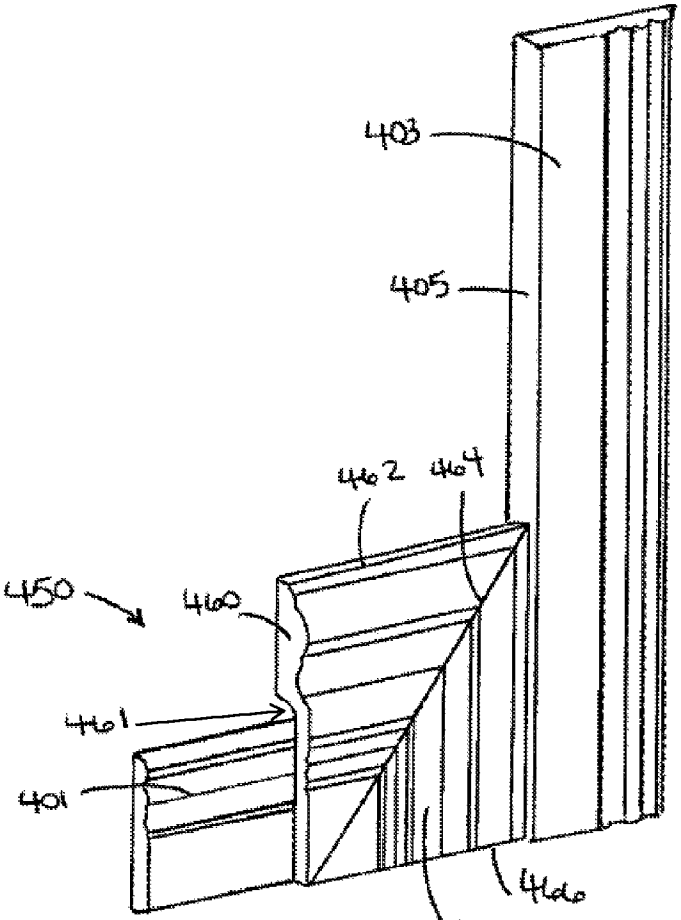
FIG. 48 is a schematic perspective assembly drawing showing the mitered baseboard return installed with existing baseboard and door casing.
Figure 49:
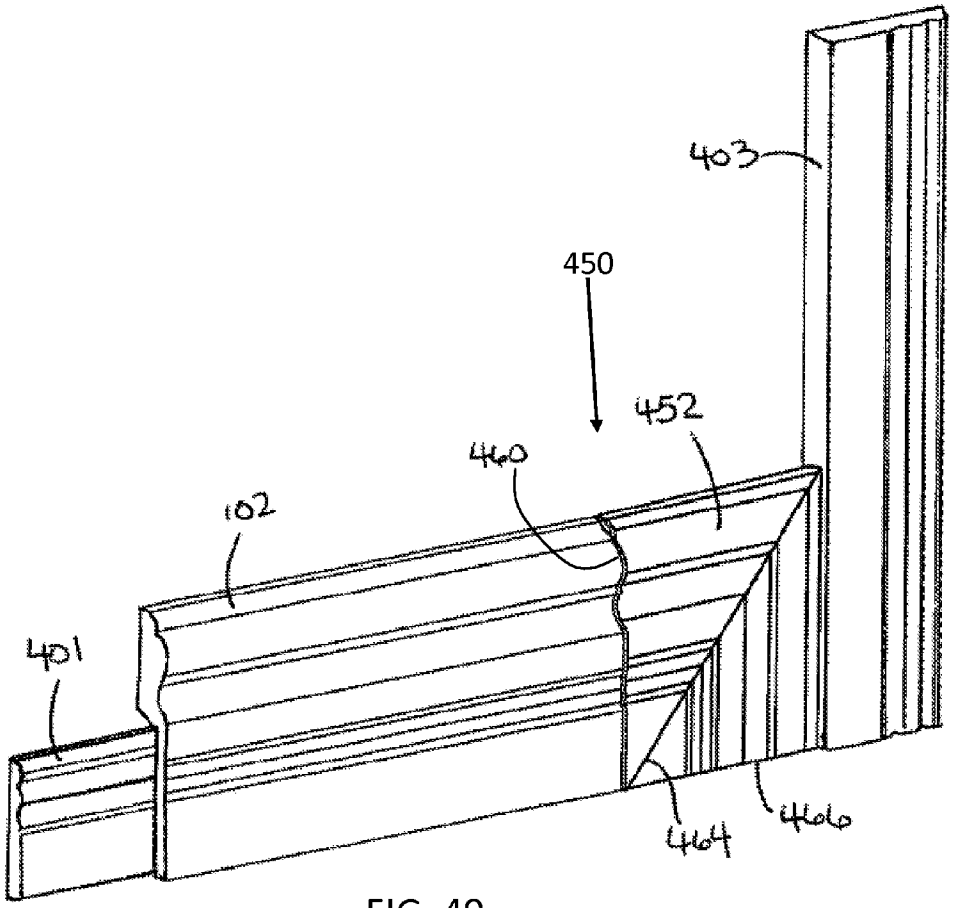
FIG. 49 is a schematic perspective assembly drawing showing the mitered baseboard return installed with existing baseboard and door casing and capping baseboard.

Mitered baseboard return 450 is shown deployed in FIGS. 48 and 49 together with an existing casing 403, having a casing abutting side 405 together with an existing baseboard 401. FIGS. 48 and 49 again show mitered baseboard return 450 being used in situations where there is an existing baseboard 401 being covered up with a capping baseboard 102. Mitered baseboard return 450 could just as easily be used in situations where there is no existing baseboard 401 that needs capping over with capping baseboard 102. In order to install mitered baseboard return 450 and/or for that matter baseboard return 400, one must cut away a portion of the existing baseboard 401 in order to accommodate baseboard return 400 or mitered baseboard return 450. Due to the profile of mitered baseboard return 450, casing abutting heads 458 is much thinner than casing abutting side 405, therefore providing for an esthetically pleasing finish and/or look. Baseboard abutting surface 460 abuts up against capping baseboard 102 as shown in FIG. 49 in order to complete the transition from baseboard to casing 403.

Figures 50, 51, 52, 53:
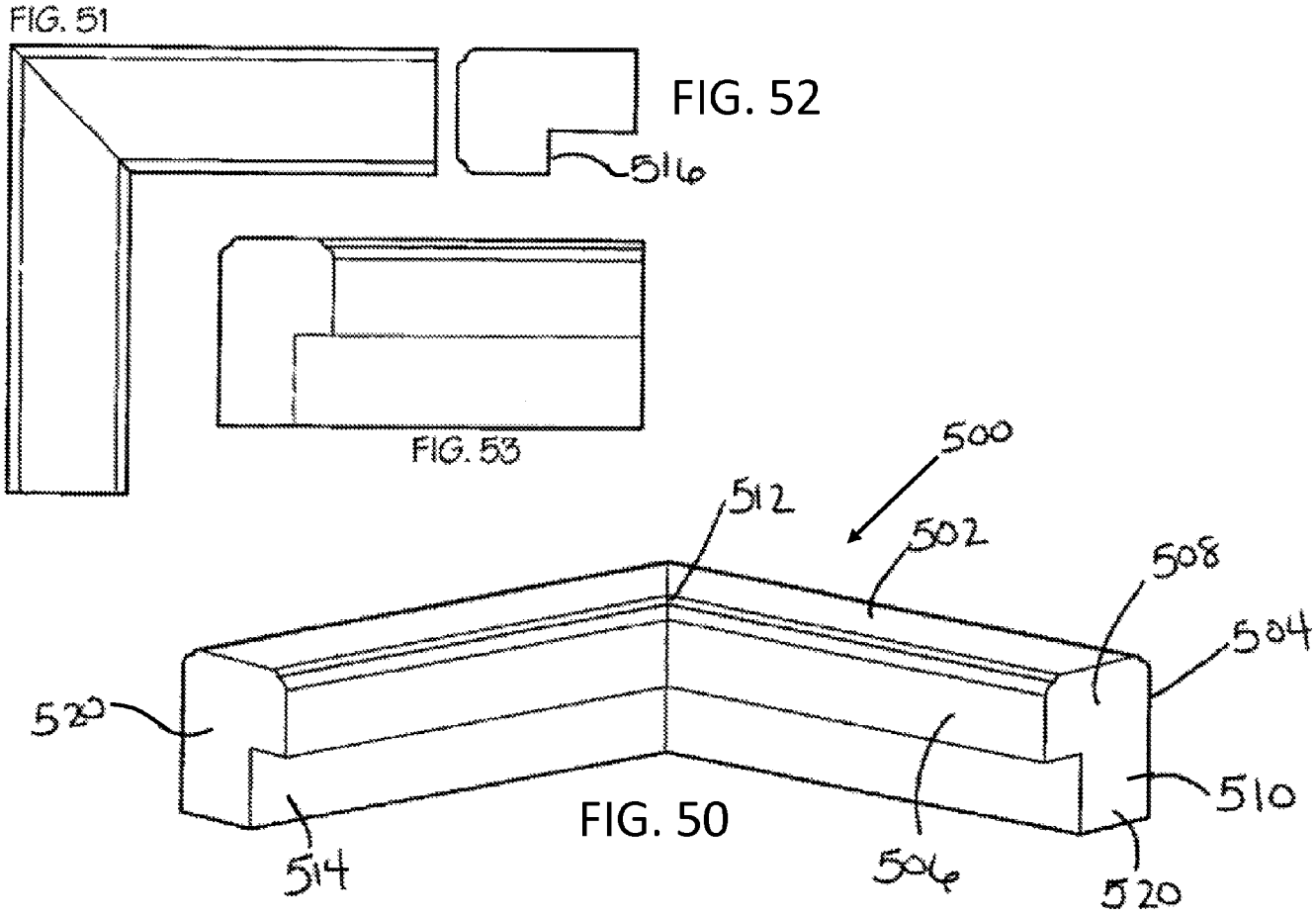
FIG. 50 is a perspective view of a back band mitered corner.
FIG. 51 is a top elevational view of a back band mitered corner.
FIG. 52 is a end elevational view of a back band mitered corner
FIG. 53 is an side elevational view of a back band mitered corner.
Figure 56:
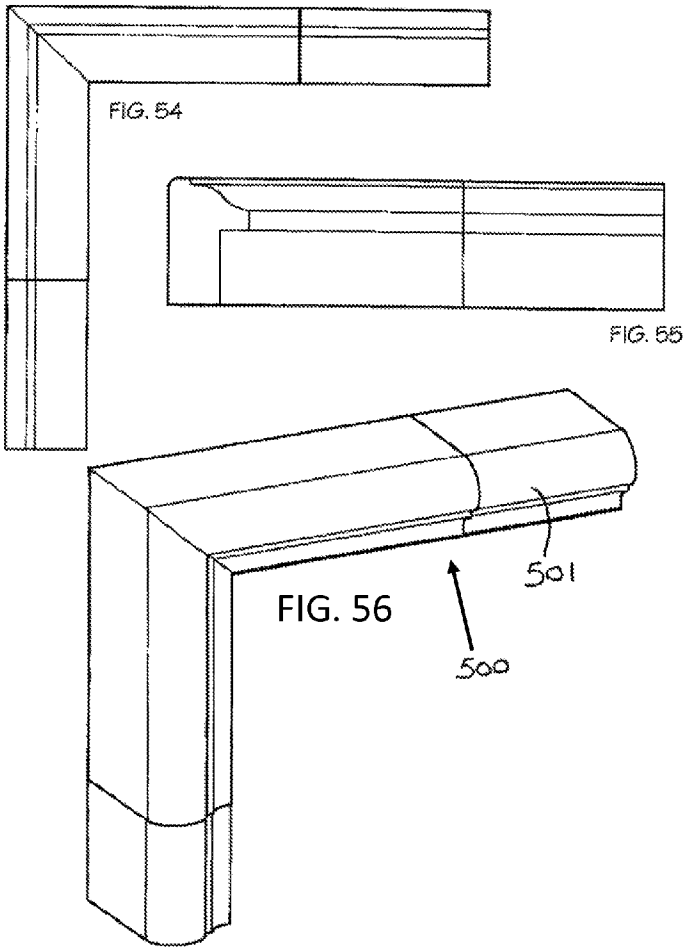
FIG. 56 is a schematic perspective assembly view of a back band mitered corner together with an existing back band.

Referring now to FIGS. 51 through 56, a back band mitered corner is shown, which includes a top surface 502, a side surface 504, a inner surface 506 having an L-shaped profile with a top leg 508 of the L-shape and a bottom leg 510 of L-shape. Back band mitered corner 500 further includes a mitered joint 512, a side abutting surface 514, a top abutting surface 516 and an end abutting surface 520. Back band mitered corner 500 can be profiled to match the existing back band 501 as shown in FIGS. 54, 55 and 56 and/or it can be a generic universal type back band shape as shown in FIGS. 50 through 51, in which case the profile of back band mitered corner 500 does not necessarily have to match the profile of the existing back band 501.

Back band mitered corner 500 is deployed in situations where there is an existing casing and one is looking to add a back band around the existing casing. In order to provide for a miterless fit, the back band mitered corner component 500 can be used in order to provide for an esthetically pleasing and an easy do it yourself abutting joint type fit. In this manner, one can avoid having to miter corners on the site.

Figures 57, 58, 59:
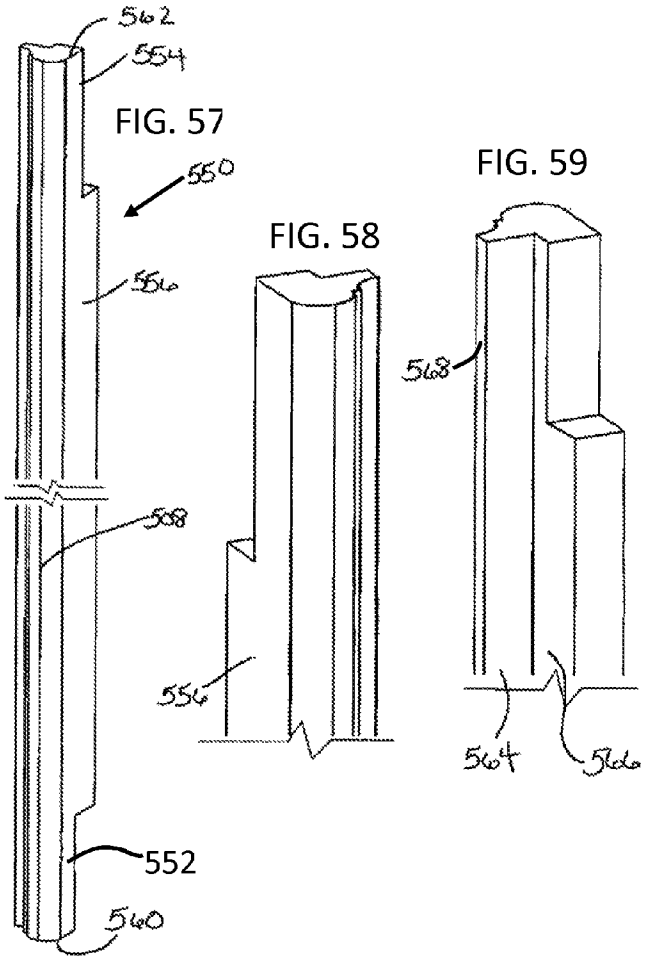
FIG. 57 is a schematic perspective view of a lineal back band.
FIG. 58 is a schematic perspective view of a front top portion of the lineal back band.
FIG. 59 is a schematic perspective view of a back top portion of the lineal back band.
Figures 66, 67:
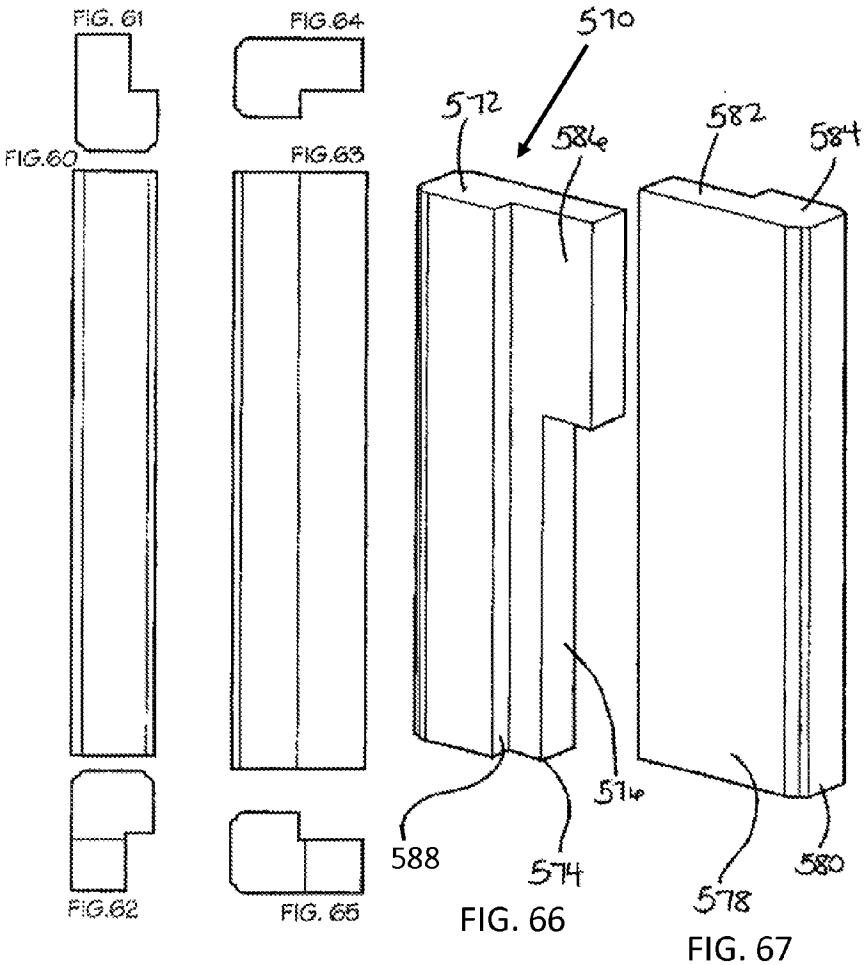
FIG. 66 is a schematic perspective view of a back side of a transition back band.
FIG. 67 is a schematic perspective view of a front side of a transition back band.

Now referring to FIGS. 57, 58 and 59 a lineal back band 550 is shown in FIG. 57, having an indefinite length and including a bottom relief 552, a top relief 554, a side surface 556, a top surface 558, a bottom end 550 and a top end 562. Lineal back band 550 further includes a further surface 568, a top abutting surface 564 and a side abutting surface 566. Lineal back band 550 includes a bottom relief 552 and a top relief 554 which can be used for installation over an existing baseboard 401. The top and bottom in 562 and 560 respectively both have relief portions namely top relief 554 and bottom relief 552, such that the back band can be used in left hand installation and/or in a right hand installation. The balance of lineal back band 550 is simply trimmed to the length required and the unused portion discarded.

Now referring to FIGS. 60 through 69, a transition back band 570 which is an alternate to a lineal back band 550 is shown. Transition back band 570 includes a top end 572, a bottom end 574, a relief 576, a side surface 578, and a top surface 580. Again transition back bend 570 has a generally L-shaped profile as shown in the figures, wherein the L-shaped profile has a bottom leg 582 and generally a top leg 584. Transition back band 570 further includes a side abutting surface 586 and a top abutting surface 588.

Figures 68, 69:
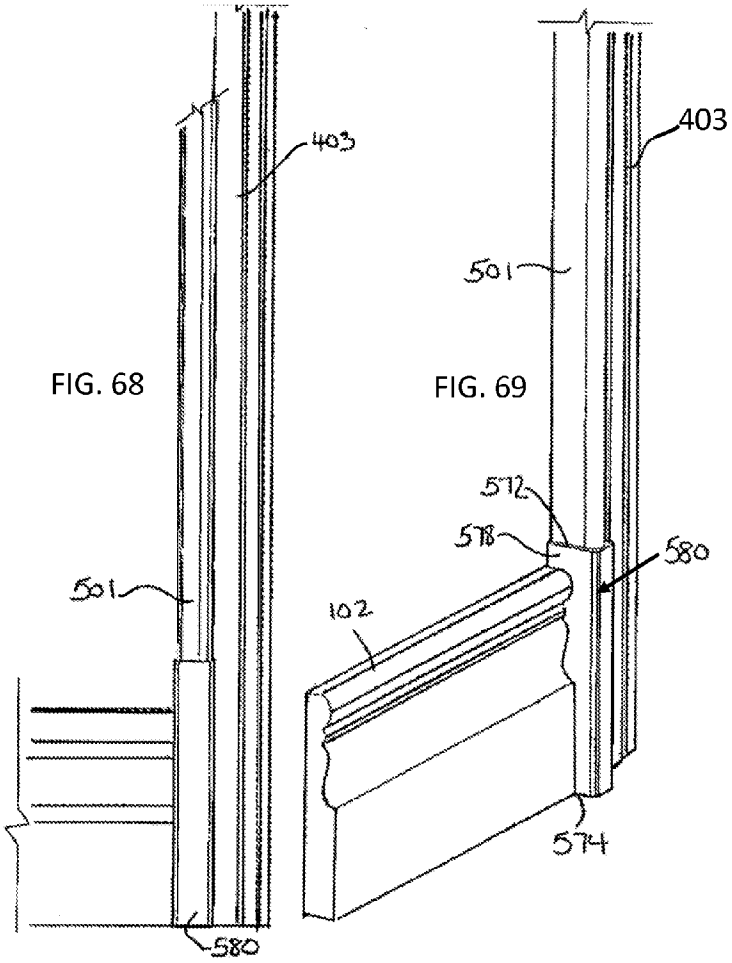
FIG. 68 is a front elevational schematic assembly drawing showing the transition back band installed with existing baseboard and door back band.
FIG. 69 is a schematic perspective assembly drawing showing the transition back band installed with existing baseboard and door back band.
Figure 70:
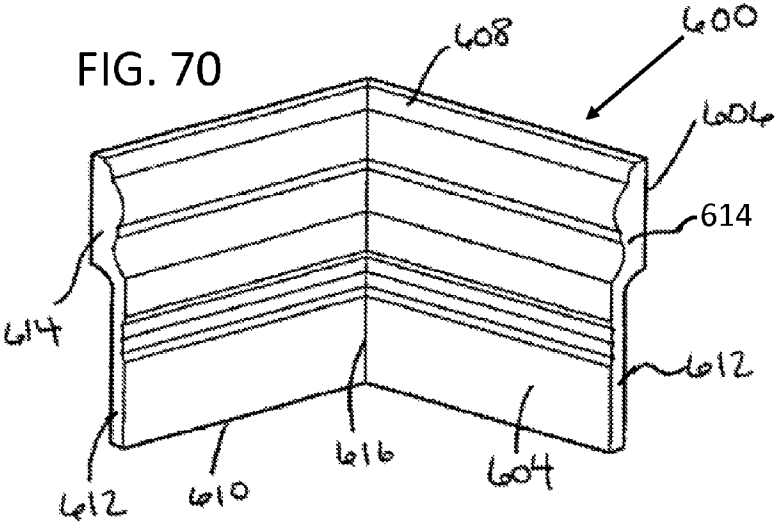
FIG. 70 is a schematic perspective view of a mitered inside baseboard corner.

FIGS. 68 and 69 show transition back band 570 deployed together with a capping baseboard 102 and an existing back band 501 and an existing casing 403. Not shown is an existing baseboard 401 which is covered over with a capping baseboard 102. Transition back band 570 is positioned and sandwiched in between capping baseboard 102 and the existing casing 403 as depicted in FIGS. 68 and 69. Capping baseboard 102 abuts against side surface 578 and back band 501 abuts against top end 572 of transition back band 570. As depicted in FIGS. 68 and 69, transition back band 570 can be of the generic type used with any type of back band profile and/or baseboard profile. The reader should note that transition back band 570 can be used in situations where a capping baseboard 102 is used and/or where the baseboard is not of a capping type, but rather is just a regular baseboard and there is not covering up of an existing baseboard. In other words, transition back band 570 can be used in any green or new installations where baseboard casings and back bands are being installed especially for the first time, rather than in the situation where one is attempting to cover up an existing baseboard.

FIGS. 70 through 73 depict mitered inside baseboard corner 600 and mitered outside baseboard corner 602.

Mitered inside baseboard corner 600 includes a front side 604, a backside 606, a top edge 608, a bottom edge 610, a relief 612, abutting surface 614 and a mitered line 616.

Figure 71:
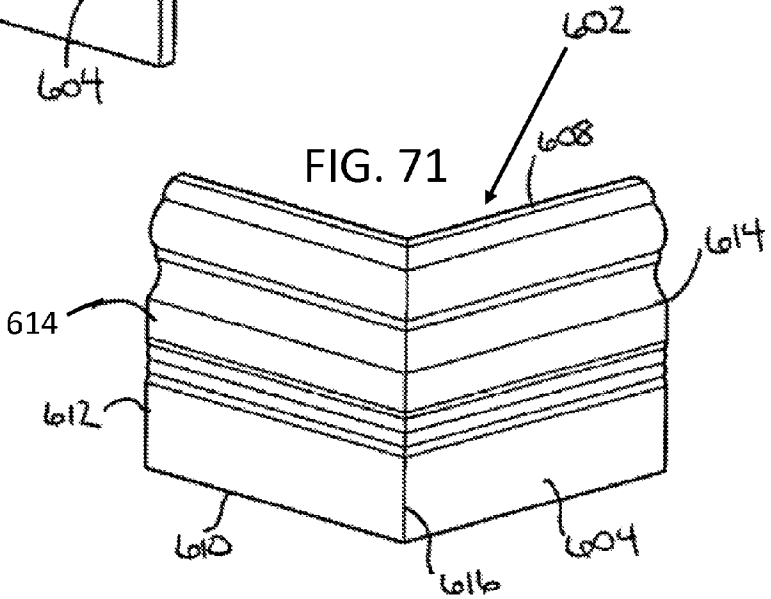
FIG. 71 is a schematic perspective view of a mitered outside baseboard corner.

Mitered outside baseboard corner 602 essentially includes the same elements as mitered inside baseboard corner 600, some of which are hidden due to the view depicted in FIG. 71.

Particularly mitered outside baseboard corner 602 includes abutting surfaces 614 and includes a relief 612 not shown and includes a back side 606 not shown.

Figure 72:
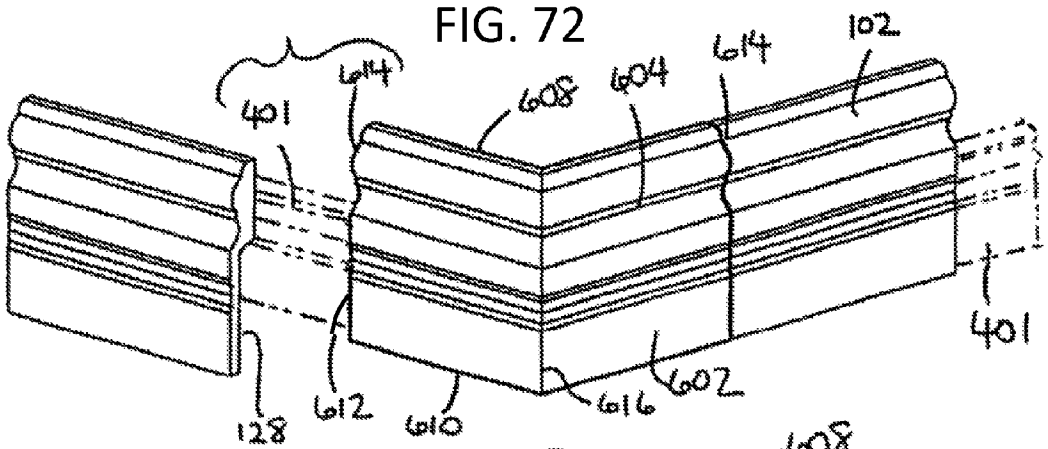
FIG. 72 is a front elevational schematic assembly drawing showing the mitered inside baseboard corner With existing baseboard.
Figure 73:
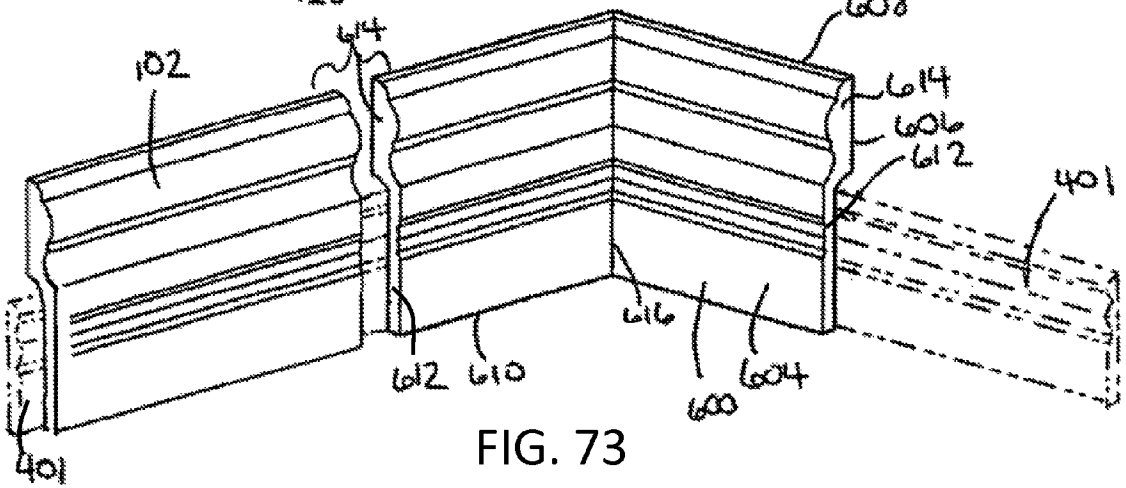
FIG. 73 is a front elevational schematic assembly drawing showing the mitered outside baseboard corner with existing baseboard.

In use, mitered inside baseboard corner 600 and mitered outside baseboard corner 602 are shown deployed over the top of an existing baseboard 401 together with a capping baseboard 102 in an outside corner situation in FIG. 72 and in an inside corner situation in FIG. 73.

The reader will note that capping baseboard 102 abuts against abutting surface 614 of both the mitered inside baseboard corner 600 and the mitered outside baseboard corner 602. In this fashion an esthetically pleasing inside and/or outside corner can be obtained without having to resort to mitering. Both mitered inside baseboard corner 600 and mitered outside baseboard corner 602 can be deployed in a situation where there is an existing baseboard as depicted in FIGS. 72 and 73, namely existing baseboard 401 which is being capped over with capping baseboard 102. It can equally as well be deployed in situations where baseboard is being newly installed along the walls, rather than where capping, baseboard is being installed over previously existing baseboard 401.

Figures 74, 75:
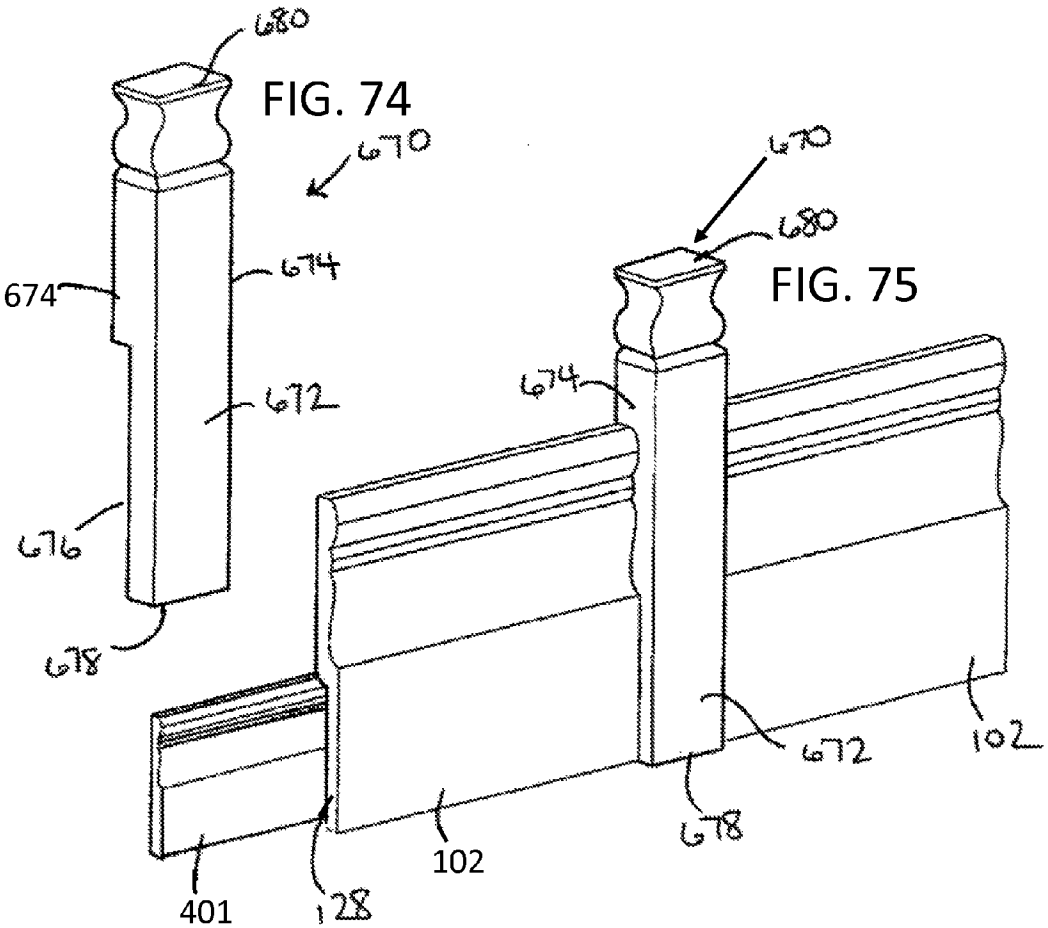
FIG. 74 is a schematic perspective view of a divider pin.
FIG. 75 is a front elevational schematic assembly drawing showing the divider pin with existing baseboard and capping baseboard.

FIGS. 74 and 75 shows a divider pin 670 which has a front side 672, an abutting surface 674, a relief 676, a bottom 678 and a top 680.

In use, divider pin 670 is used in situations where two capping baseboards 102 and/or regular baseboards are joined together in lineal fashion. In other words, if the length of the baseboard is not long enough to extend the entire length of one side of a wall, one must then create a joint between two existing baseboards. This is normally done now by abutting and/or by using a taper and/or some type of a dove tail fit between the two baseboards. One can eliminate mitering of this joint by using divider pin 670 which can also be used in over molding or a capping application as shown in FIG. 75 where an existing baseboard 401 is being capped over by capping baseboard 102. Divider pin 670 is used in this situation since it includes a relief 676. Divider pin 670 could also be used in a green or a new installation of baseboard along a wall.

Figure 76:
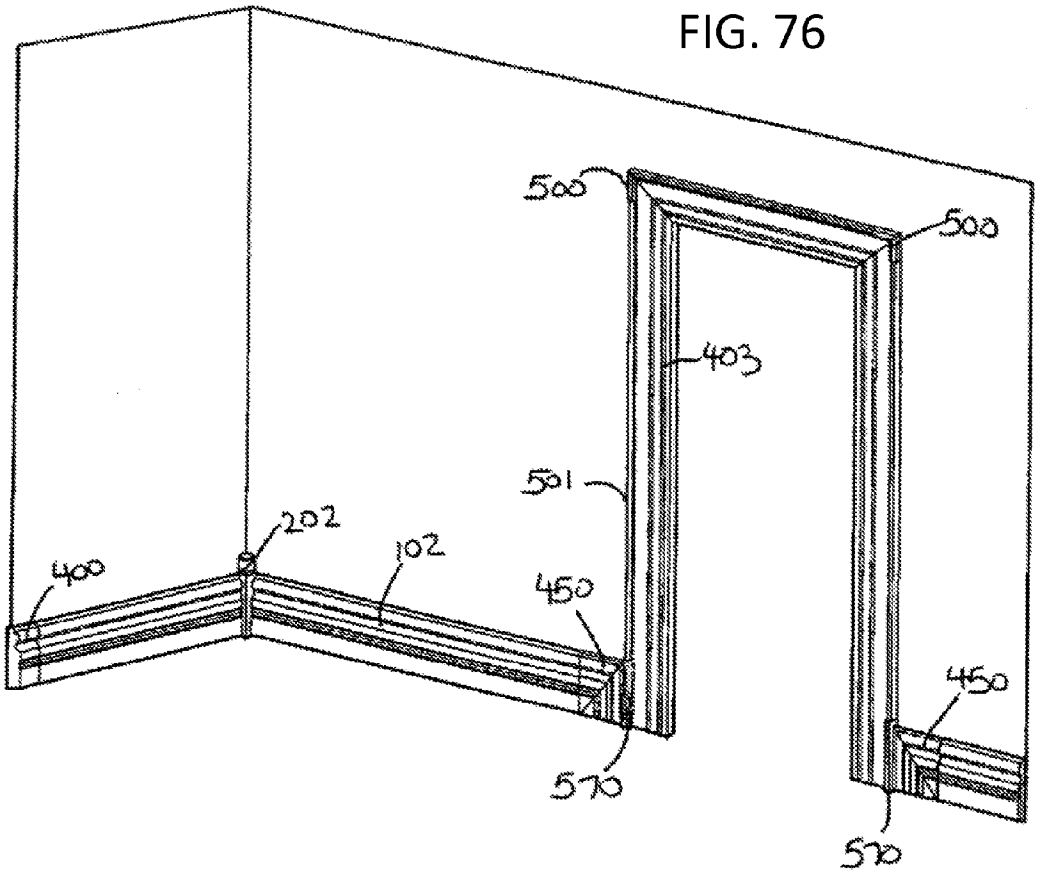
FIG. 76 is a schematic perspective assembly drawing showing a partial wall section and the various components with existing baseboard and door casing.
Figure 77:
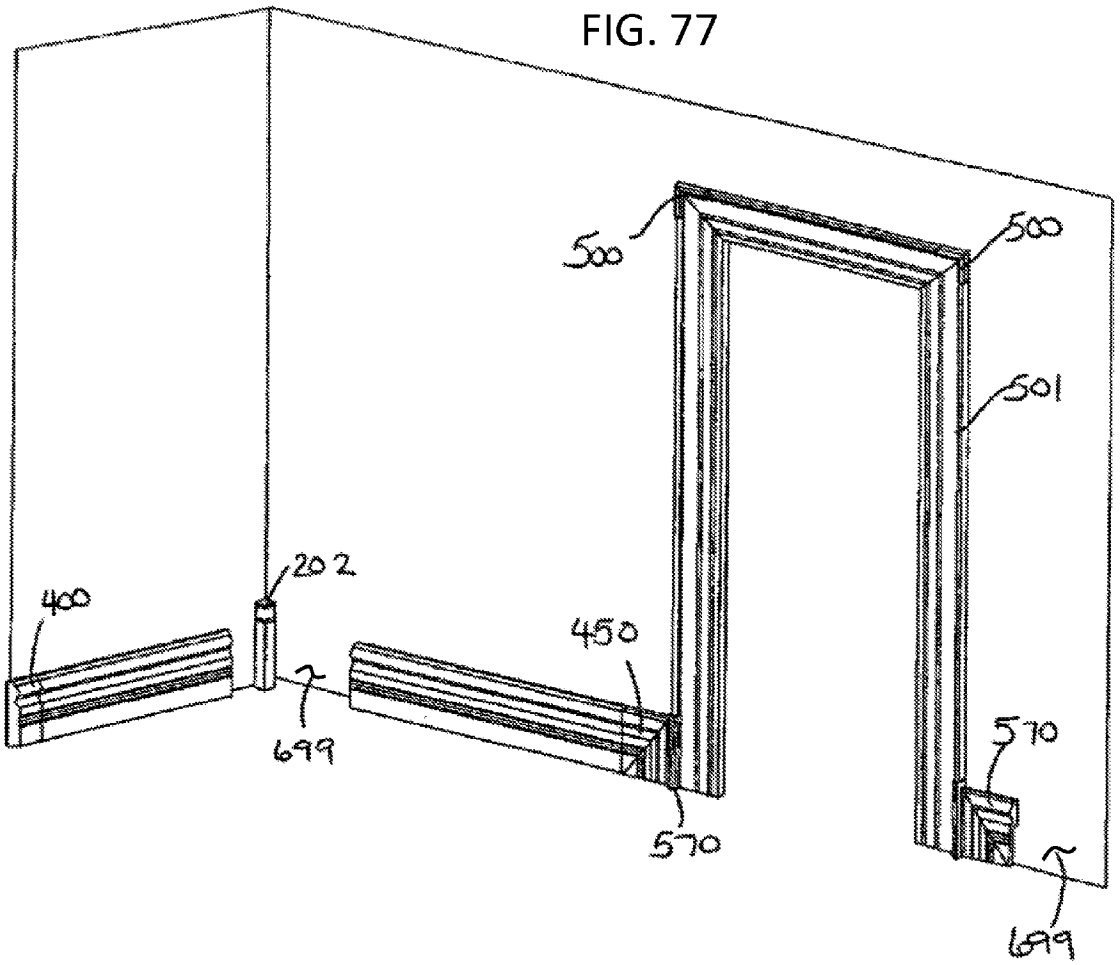
FIG. 77 is a schematic perspective assembly drawing showing a partial wall section and the various components with existing baseboard and door casing.
Figure 78:
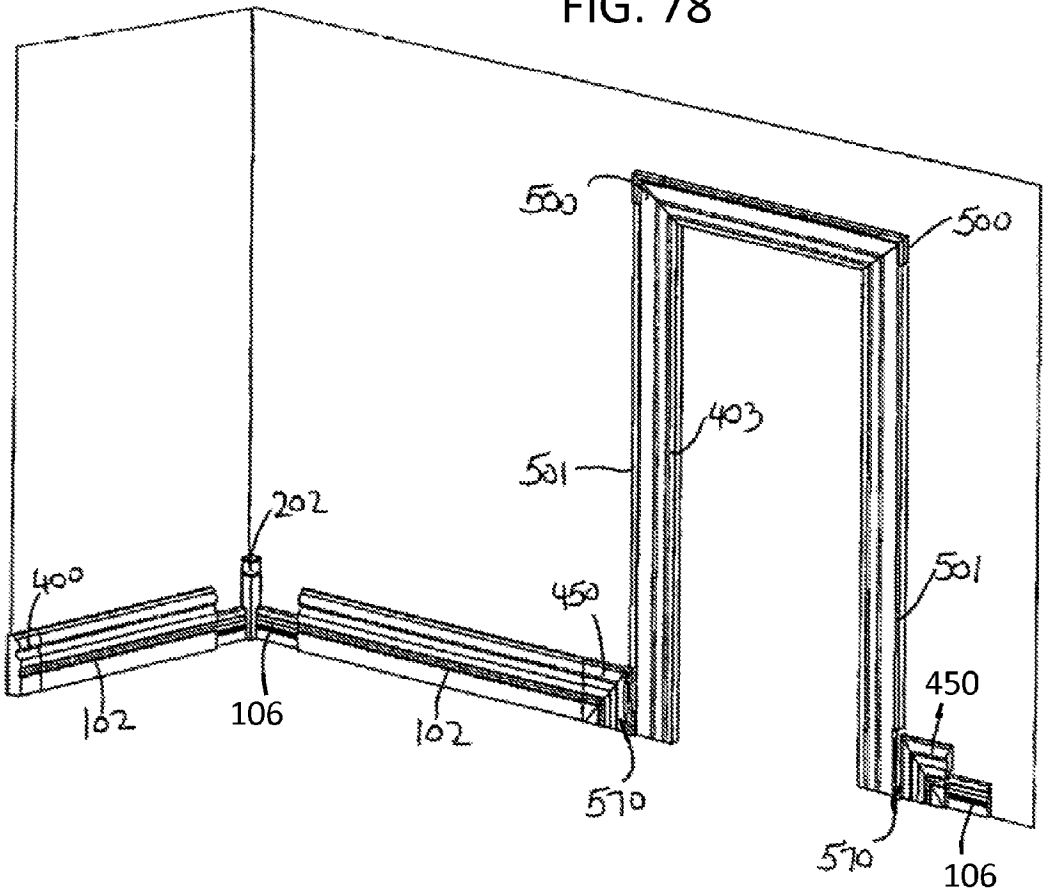
FIG. 78 is a schematic perspective assembly drawing showing a partial wall section and the various components with existing baseboard and door casing.

FIGS. 76, 77 and 78 depict all of the various components that have been described here above showing the trim molding system and all of its components that are being claimed in this patent application.

FIG. 76 for example, shows all the above mentioned components which have been installed onto the wall and/or around the outer periphery of the doorway in a miterless trim molding system.

In inside corner, inside base pin 202 is placed and is abutted by capping baseboards 102 on each side thereof. One end of capping baseboards 102 is finished off with baseboard return 400 and the other end is finished off with mitered baseboard return 450. Mitered baseboard return 450 abuts against transition back band 570 and back bend 501 is installed over existing casing 403 using back band mitered corners 500 at each of the above top two corners of the doorway.

On the right side of the doorway, again mitered baseboard return 450 is used and is abutting against transition back band 570.

In this installation, lineal back band 550 could also easily be used which would eliminate the need of transition back band piece 570 and one could continue to use back band mitered corners 500 at the top of these corners.

FIG. 77 shows all of these same components in place, however in this situation, there is no existing baseboard, but rather gap 699 which show that the baseboard and all of the components mentioned and depicted in FIG. 76 are not overtop of an existing baseboard, but rather are installed in a green and/or in the new application.

FIG. 78 again shows the same components, however in this instance the figure reveals that there is an existing baseboard 106 behind capping baseboard 102 and all of the above mentioned components which were described above and shown in FIG. 76 can be used in a situation where an existing baseboard 106 and an existing facing 403 is in place.

What is claimed is:

1. A molding system for a wall surface, the wall surface having an existing baseboard disposed adjacent a floor and abutting a doorway, the doorway having an existing molding disposed around at least one vertical and at least one upper horizontal peripheral doorway edge, the existing molding having at least one vertical casing section adjacent the at least one vertical peripheral doorway edge and at least one horizontal casing section adjacent the at least one upper horizontal peripheral doorway edge, said at least one vertical casing section having an outer edge spaced from the vertical peripheral doorway edge, the system comprising:

a) a capping baseboard that is attachable to the wall surface in covering relationship with the existing baseboard, the capping baseboard having an outer back surface defining an existing baseboard-receiving relief portion that includes a relief back surface spanning upwardly from a bottom end of the capping baseboard to a transition portion and adapted to facilitate such covering relationship, the transition portion separating the outer back surface and the relief back surface and of at least one of a planar and a vertically inclining orientation; and b) a baseboard return attachable to the wall surface and disposed between the at least one vertical casing section adjacent the at least one vertical peripheral doorway edge and the capping baseboard, said baseboard return having an exposed body section having a front exposed surface, a back surface, a top end and a bottom end, a baseboard abutting surface on one side for abutting with the capping baseboard, and a casing abutting surface on the other side for abutting with the vertical casing section of the existing molding, and wherein the baseboard return and the capping baseboard each have a height and a thickness and the baseboard return height and thickness is equal to or greater than the capping baseboard height and thickness.

2. The molding system of claim 1 wherein the baseboard return further includes a tapered section adjacent the baseboard return body section and terminating at the casing abutting surface.

3. The molding system of claim 1 wherein the relief portion has a profile that is complementary to the profile of the existing baseboard.

4. The molding system of claim 1 wherein the baseboard return further includes a mitered line running diagonally from the bottom end to the top end.

5. The molding system of claim 1 further including a divider pin having:

a) a bottom, a top, and a front side; and b) the divider pin further including abutting surfaces on each side for abutting with the capping baseboard on each side.

6. The molding system of claim 1 further including a transition back band disposed around the at least one vertical and the at least one upper horizontal peripheral doorway edges, the transition back band comprising:

a) a generally L shaped cross sectional profile including a bottom leg and a top leg; and b) wherein the bottom leg includes a relief for accommodating the existing baseboard therein.

7. The molding system of claim 6 wherein the transition back band further includes a bottom end for abutting with the floor and a top end for abutting with a back band.

8. The molding system of claim 7 wherein the transition back band further includes a side abutting surface and a top abutting surface both for placement adjacent and abutting with the at least one vertical casing section.

9. A retrofit molding system for covering existing molding about a wall surface defining a doorway opening and existing baseboard molding disposed on the wall surface adjacent a floor abutting the doorway opening, the system comprising:

at least one existing vertical molding that is attachable around at least one vertical peripheral doorway edge, and at least one vertical casing section adjacent the at least one vertical peripheral doorway edge, the at least one vertical casing section having an outer edge spaced from the at least one vertical doorway peripheral edge;

at least one existing horizontal molding that is attachable to at least one upper horizontal peripheral doorway edge, and at least one horizontal casing section adjacent the at least one horizontal peripheral doorway edge;

a capping baseboard that is attachable to the wall surface in covering relationship with the existing baseboard, the capping baseboard having a back surface defining an existing-baseboard-receiving relief portion adapted to facilitate the covering relationship;

a baseboard return attachable to the wall surface and disposed between the at least one adjacent vertical casing section of the at least one existing vertical peripheral doorway edge and the capping baseboard, wherein a portion of the existing baseboard adjacent the doorway is removed to accommodate the baseboard return, said baseboard return having an exposed body section having a front exposed surface, a back surface, a top end and a bottom end, a baseboard abutting surface on one side for abutting with the capping baseboard, and a casing abutting surface on the other side for abutting with the vertical casing section of the existing molding; and the baseboard return and the capping baseboard each have a height and a thickness and the baseboard return height and thickness is equal to or greater than the capping baseboard height and thickness.

10. A molding system adapted to be assembled in the field at a wall surface, the wall surface having an existing baseboard disposed adjacent a floor and abutting a doorway, the doorway having an existing molding disposed around at least one vertical and at least one upper horizontal peripheral doorway edge, the existing molding having at least one vertical casing section adjacent the at least one doorway vertical peripheral edge and at least one horizontal casing section adjacent the at least one upper horizontal doorway peripheral edge, said at least one vertical casing section having an outer edge spaced from the doorway vertical peripheral edge, the system comprising:

a capping baseboard attached to the wall surface in covering relationship with the existing baseboard;

a baseboard return attached to the wall surface and disposed between the at least one adjacent vertical casing section of the at least one existing vertical peripheral doorway edge and the capping baseboard, wherein a portion of the existing baseboard adjacent the doorway is removed to accommodate the baseboard return, said baseboard return having an exposed body section having a front exposed surface, a back surface, a top end and a bottom end, a baseboard abutting surface on one side for abutting with the capping baseboard, and a casing abutting surface on the other side for abutting with the vertical casing section of the existing molding, and the baseboard return and the capping baseboard each have a height and a thickness and the baseboard return height and thickness is equal to or greater than the capping baseboard height and thickness.

* * * * *